US009974706B2

(12) United States Patent
Ikebe et al.

(10) Patent No.: US 9,974,706 B2
(45) Date of Patent: May 22, 2018

(54) DRIVING DEVICE AND DRIVING METHOD

(71) Applicant: Seiko Epson Corporation, Tokyo (JP)

(72) Inventors: Tomo Ikebe, Suwa (JP); Yutaka Arakawa, Hara (JP); Tomohisa Iwazaki, Matsumoto (JP)

(73) Assignee: Seiko Epson Corporation (JP)

( * ) Notice: Subject to any disclaimer, the term of this patent is extended or adjusted under 35 U.S.C. 154(b) by 396 days.

(21) Appl. No.: 14/723,861

(22) Filed: May 28, 2015

(65) Prior Publication Data

US 2015/0342818 A1 Dec. 3, 2015

(30) Foreign Application Priority Data

May 29, 2014 (JP) ..... 2014-111177
Jun. 17, 2014 (JP) ..... 2014-123919

(51) Int. Cl.
*A61H 1/02* (2006.01)
*A61H 23/02* (2006.01)

(52) U.S. Cl.
CPC ..... *A61H 1/0288* (2013.01); *A61H 23/0245* (2013.01); *A61H 2201/123* (2013.01); *A61H 2201/1238* (2013.01); *A61H 2201/165* (2013.01); *A61H 2201/5061* (2013.01)

(58) Field of Classification Search
CPC ..... A61H 1/0288; A61H 23/0245; A61H 2201/123; A61H 2201/1238; A61H 2201/165; A61H 2201/5061
USPC ..... 601/40
See application file for complete search history.

(56) References Cited

U.S. PATENT DOCUMENTS

| | | | |
|---|---|---|---|
| 7,224,102 | B2 | 5/2007 | Miyazawa |
| 8,029,414 | B2 | 10/2011 | Ingvast et al. |
| 8,255,079 | B2 | 8/2012 | Linn et al. |
| 8,425,438 | B2 | 4/2013 | Fujimoto et al. |
| 8,849,453 | B2 | 9/2014 | Bergelin et al. |
| 2012/0029399 | A1 | 2/2012 | Sankai |
| 2013/0219586 | A1 | 8/2013 | Ihrke et al. |
| 2014/0288664 | A1 | 9/2014 | Miyazawa |

FOREIGN PATENT DOCUMENTS

| | | | |
|---|---|---|---|
| JP | H11-056931 | A | 3/1999 |
| JP | 11-253504 | A | 9/1999 |
| JP | 2000-070312 | A | 3/2000 |
| JP | 2002-345861 | A | 12/2002 |
| JP | 2004-320979 | A | 11/2004 |
| JP | 2009-112578 | A | 5/2009 |
| JP | 2010-502266 | A | 1/2010 |

(Continued)

*Primary Examiner* — Andrew S Lo
(74) *Attorney, Agent, or Firm* — Harness, Dickey & Pierce, P.L.C.

(57) ABSTRACT

A driving device includes a wearable mechanism that is worn on a wearing part, an actuator that drives the wearable mechanism, and first and second force sensors that are provided on the wearable mechanism and detect a force. The first and second force sensors are provided at positions at which a first detected value obtained from the first force sensor and a second detected value obtained from the second force sensor are changed in response to a motion of the wearing part. When a difference between the first and second detected values is less than a pre-decided first threshold value and the first or second detected value is greater than a pre-decided second threshold value, the actuator drives the wearable mechanism so that the second detected value is constant.

10 Claims, 23 Drawing Sheets

(56) References Cited

FOREIGN PATENT DOCUMENTS

| | | | |
|---|---|---|---|
| JP | 2010-240285 | A | 10/2010 |
| JP | 2011-067609 | A | 4/2011 |
| JP | 2011-115248 | A | 6/2011 |
| JP | 2013-180199 | A | 9/2013 |
| JP | 2013-181271 | A | 9/2013 |
| JP | 2014-068869 | A | 4/2014 |
| JP | 2014-180298 | A | 9/2014 |
| JP | 2014-184027 | A | 10/2014 |
| WO | WO-2008-027002 | A1 | 3/2008 |

DRIVING DEVICE AND DRIVING METHOD

BACKGROUND

1. Technical Field

The present invention relates to a driving device and a driving method.

2. Related Art

In the past, driving devices worn on hands to assist movements of fingers in a wearing state, that is, to flex and stretch (bend and spread) finger joints, have been proposed as in a finger movement auxiliary device disclosed in JP-A-2002-345861 and a wearing type movement support device disclosed in JP-A-2011-115248.

However, it is difficult to detect whether wearers wearing driving devices are attempting to bend their fingers or spread their fingers, that is, the intention of the wearers in regard to the movements. The above-mentioned technologies of the related art have the problem that it is difficult to appropriately support (assist) flexing and stretching movements of fingers although the postures or positions of the fingers can be controlled. This problem is common to driving devices assisting motions of various parts such as toes, elbows, wrists, knees, necks, and waists, as well as driving devices assisting motions of the finger joints of human beings. This problem is also common to driving devices assisting motions of biological parts of animals and non-biological parts of robots or the like, as well as human beings.

SUMMARY

An advantage of some aspects of the invention is to solve at least a part of the problems described above, and the invention can be implemented as the following forms.

(1) An aspect of the invention provides a driving device. The driving device includes: a wearable mechanism that is worn on a wearing part; an actuator that drives the wearable mechanism; and first and second force sensors that are provided on the wearable mechanism and detect a force. The first and second force sensors are provided at positions at which a first detected value obtained from the first force sensor and a second detected value obtained from the second force sensor are changed in response to a motion of the wearing part. When a difference between the first and second detected values is less than a pre-decided first threshold value and the first or second detected value is greater than a pre-decided second threshold value, the actuator drives the wearable mechanism so that the second detected value is constant.

In the driving device according to the aspect of the invention, the wearable mechanism can be driven according to the first detected value detected by the first force sensor and the second detected value detected by the second force sensor. Specifically, when the difference between the first and second detected values is less than the pre-decided first threshold value and the first or second detected value is greater than the pre-decided second threshold value, the actuator drives the wearable mechanism so that the second detected value is constant.

(2) In the driving device according to the aspect of the invention described above, the actuator may drive the wearable mechanism based on the first or second detected value when the difference between the first and second detected values is equal to or greater than the first threshold value. The driving device according to this aspect of the invention can assist the movement of the wearing part by detecting a motion state of the wearing part on which the wearable mechanism is worn according to the first detected value detected by the first force sensor and the second detected value detected by the second force sensor and driving the wearable mechanism.

(3) In the driving device according to the aspect of the invention described above, the wearing part may be a finger. The first force sensor may be disposed on a dorsal side of the finger. The second force sensor may be disposed on a ventral side of the finger. The driving device according to this aspect of the invention can assist a motion of a finger by detecting a motion state of the finger on which the wearable mechanism is worn by the first and second force sensors and driving the wearable mechanism based on the first and second detected values.

(4) In the driving device according to the aspect of the invention described above, the first and second force sensors may be disposed to face each other in a direction in which the finger is rotated. The driving device according to this aspect of the invention can exclude a moment component in bending and spreading motions of the finger from the detected values detected by the first and second force sensors and detect the motion state of a part of the finger with high accuracy.

(5) In the driving device according to the aspect of the invention described above, the wearable mechanism may include at least one of assistant units including an assistant portion that is disposed on the dorsal side of the finger and an interposing portion that is fixed to the assistant portion and interposes the finger to cover the ventral side of the finger. The first force sensor may be disposed on a surface of the assistant portion on the dorsal side of the finger. The second force sensor may be disposed on a surface of the interposing portion on the ventral side of the finger. The driving device may include a control unit that controls a movement of the actuator. Here, a) the control unit may determine that a movement state is a free stop state in which a hand including the finger does not grip a gripping target and stops when the difference between the first and second detected values is less than the first threshold value and the first or second detected value is less than the second threshold value, b) the control unit may determine that the movement state is a grip force maintenance state in which the hand grips the gripping target with a constant grip force when the difference between the first and second detected values is less than the first threshold value and the first or second detected value is equal to or greater than the second threshold value, c) the control unit may determine that the movement state is a free grasp movement state in which the hand grips the gripping target from the state in which the hand does not grip the gripping target when the difference between the first and second detected values is equal to or greater than the first threshold value, the second detected value is greater than the first detected value, and the first detected value is less than the second threshold value, d) the control unit may determine that the movement state is a grip progress state in which the hand grips the gripping target from the state in which the hand grips the gripping target when the difference between the first and second detected values is equal to or greater than the first threshold value, the second detected value is greater than the first detected value, and the first detected value is equal to or greater than the second threshold value, e) the control unit may determine that the movement state is a grip release movement state in which the hand opens from the state in which the hand grips the gripping target when the difference between the first and second detected values is equal to or greater than the first threshold value, the second detected value is equal to or less than the first detected value, and the second detected value is equal to or greater than the second threshold value, and f) the control unit may determine that the movement state is a free release movement state in which the hand opens from the state in which the hand does not grip the gripping target when the difference between the first and second detected values is equal to or greater than the first threshold value, the second detected value is equal to or less than the first detected value, and the second detected value is less than the second threshold value.

The driving device according to this aspect of the invention can determine a movement state of the hand based on the first detected value detected by the first force sensor and the second detected value detected by the second force sensor and the actuator can drive the wearable mechanism based on the movement state, so that a motion of the hand, specifically, a motion of the finger on which the driving device is worn, can be assisted.

(6) In the driving device according to the aspect of the invention described above, the wearable mechanism may include at least one of assistant units including an assistant portion that is disposed on the dorsal side of the finger and an interposing portion that is fixed to the assistant portion and interposes the finger to cover the ventral side of the finger. The first force sensor may be disposed on a surface of the assistant portion on the dorsal side of the finger. The second force sensor may be disposed on an opposite surface of the interposing portion to the ventral side of the finger. The first detected value may be a value obtained by subtracting an offset value according to a wearing pressure occurring when the wearable mechanism is worn on the finger. The driving device may include a control unit that controls a movement of the actuator. Here, a) the control unit may determine that a movement state is a free stop state in which a hand including the finger does not grip a gripping target and stops when the difference between the first and second detected values is less than the first threshold value and the second detected value is equal to or less than the second threshold value, b) the control unit may determine that the movement state is a grip force maintenance state in which the hand grips the gripping target with a constant grip force when the difference between the first and second detected values is less than the first threshold value and the second detected value is equal to or greater than the second threshold value, c) the control unit may determine that the movement state is a free grasp movement state in which the hand grips the gripping target from the state in which the hand does not grip the gripping target when the difference between the first and second detected values is equal to or greater than the first threshold value, the second detected value is equal to or less than the second threshold value, and the first detected value is less than the second detected value, d) the control unit may determine that the movement state is a grip progress state in which the hand grips the gripping target from the state in which the hand grips the gripping target when the difference between the first and second detected values is equal to or greater than the first threshold value, the second detected value is greater than the second threshold value, and the first detected value is less than the second detected value, e) the control unit may determine that the movement state is a grip release movement state in which the hand opens from the state in which the hand grips the gripping target when the difference between the first and second detected values is equal to or greater than the first threshold value, the second detected value is greater than the second threshold value, and the first detected value is equal to or greater than the second detected value, and f) the control unit may determine that the movement state is a free release movement state in which the hand opens from the state in which the hand does not grip the gripping target when the difference between the first and second detected values is equal to or greater than the first threshold value, the second detected value is equal to or less than the second threshold value, and the first detected value is equal to or greater than the second detected value.

The driving device according to this aspect of the invention can also determine a movement state of the hand based on the first detected value detected by the first force sensor and the second detected value detected by the second force sensor and the actuator can drive the wearable mechanism based on the movement state, so that a motion of the hand, specifically, a motion of the finger on which the driving device is worn, can be assisted.

(7) In the driving device according to the aspect of the invention described above, the control unit may switch a driving state of the wearable mechanism by the actuator based on the determined movement state. The driving device according to this aspect of the invention can assist a movement of the hand according to the determined movement state, specifically, a motion of the finger on which the driving device is worn. For example, a motion can be quickened in a free hand case and a motion can be slowed in a grip case.

(8) In the driving device according to the aspect of the invention described above, the actuator may include a piezoelectric driving device that generates a driving force driving the wearable mechanism. The piezoelectric driving device may include a vibration plate having first and second surfaces and a vibration structure disposed on at least one of the first and second surfaces of the vibration plate. The vibration structure may include a piezoelectric substance and first and second electrodes that interpose the piezoelectric substance. In the driving device according to this aspect of the invention, the actuator can be configured to have a simple, miniature, and thin structure, and thus the driving device can be miniaturized and thinned.

(9) Another aspect of the invention provides a driving device. The driving device includes: a wearable mechanism that is worn on a wearing part; an actuator that drives the wearable mechanism; and first and second force sensors that are provided on the wearable mechanism and detect a force. The first and second force sensors are provided at positions at which a first detected value obtained from the first force sensor and a second detected value obtained from the second force sensor are changed in response to a motion of the wearing part. When a difference between the first and second detected values is less than a pre-decided first threshold value, the first or second detected value is greater than a pre-decided second threshold value, and the wearable part comes into contact with an object provided with a third force sensor detecting a force, the actuator drives the wearable mechanism so that the second and third detected values are constant.

In the driving device according to this aspect of the invention, it can be confirmed that the wearable mechanism is driven so that the second detected value is constant, from the fact that the third detected value detected by the third force sensor is constant.

(10) Still another aspect of the invention provides a driving device assisting a motion of a living body. The driving device includes a wearable mechanism that is worn on a wearing part; an actuator that drives the wearable mechanism; and a plurality of first force sensors that are disposed between the wearable mechanism and the wearing part. In the driving device according to this aspect of the invention, a deviation or a distribution of a force generated between the wearable mechanism and the wearing part depending on the position of the wearing part can be detected with the plurality of first force sensors when the wearing part on which the wearable mechanism is worn moves. Therefore, the force generated between the wearable mechanism and the wearing part can be detected with high accuracy and the motion state of the wearing part on which the wearable mechanism is worn can be detected with high accuracy.

(11) In the driving device according to the aspect of the invention described above, the actuator may drive the wearable mechanism based on the plurality of first detected values changed in response to a motion of the wearing part and obtained from the plurality of first force sensors. The driving device according to this aspect of the invention can detect a motion state of the wearing part on which the wearable mechanism is worn with high accuracy based on the plurality of first detected values obtained by the plurality of first force sensors and can drive the wearable mechanism according to the motion state of the wearing part. Accordingly, it is possible to assist the movement of the wearing part.

(12) The driving device according to the aspect of the invention described above may include at least one second force sensor that is disposed to face the plurality of first force sensors with the wearing part therebetween. The driving device according to this aspect of the invention can also detect a force generated between the wearing part and the wearable mechanism put on the side of the second force sensor disposed to face the first force sensors with the wearing part therebetween.

(13) In the driving device according to the aspect of the invention described above, the actuator may drive the wearable mechanism based on a plurality of first detected values and at least one second detected value which are a plurality of first detected values obtained from the plurality of first force sensors and at least one second detected value obtained from at least the one second force sensor and which are changed in response to a motion of the wearing part. The driving device according to this aspect of the invention can detect a motion state of the wearing part on which the wearable mechanism is worn with high accuracy and drive the wearable mechanism according to the motion state of the wearing part based on the plurality of first detected values detected by the plurality of first force sensors and the second detected value detected by at least one second force sensor, the first force sensors and at least one second force sensor being disposed to face each other with the wearing part therebetween. Accordingly, it is possible to assist the movement of the wearing part.

(14) The driving device according to the aspect of the invention described above may include the plurality of second force sensors that are disposed to face the plurality of first force sensors with the wearing part therebetween. In the driving device according to this aspect of the invention, a distribution of a contact force between the wearing part and the wearable mechanism on the side of the first force sensors can be detected by the plurality of first force sensors, and a deviation or a distribution of a force generated between the wearable mechanism and the wearing part depending on the position of the wearing part on which the wearable mechanism is worn on the side of the second force sensors opposite to the first force sensors can be detected by the plurality of second force sensors. Therefore, it is possible to detect the force generated between the wearable mechanism and the wearing part with higher accuracy. The motion state of the wearing part on which the wearable mechanism is worn can be detected with higher accuracy based on the plurality of first detected values detected by the plurality of first force sensors and the second detected values detected by the plurality of second force sensors, and the wearable mechanism can be driven according to the motion state of the wearing part. Accordingly, it is possible to assist the movement of the wearing part.

(15) In the driving device according to the aspect of the invention described above, a pressure reception plate that is disposed to come into contact with the plurality of first force sensors may be provided between the plurality of first force sensors and the wearing part. In the driving device according to this aspect of the invention, a force generated between the assist driving device and the wearing part can be efficiently transferred to the plurality of first force sensors via the pressure reception plate. Therefore, it is possible to improve the detection accuracy of the contact force by the first force sensors.

(16) In the driving device according to the aspect of the invention described above, the wearing part may be a finger and the plurality of first force sensors may be disposed at least in the longitudinal direction of the finger on the side of the dorsal side of the finger. The driving device according to this aspect of the invention can detect the deviation or the distribution of the force generated between the wearable mechanism and the finger with high accuracy, detect the motion state of the finger on which the wearable mechanism is worn with high accuracy, and drive the wearable mechanism according to the motion state of the finger. Accordingly, it is possible to assist the movement of the finger with high accuracy.

(17) In the driving device according to the aspect of the invention described above, the actuator may include a piezoelectric driving device that generates a driving force driving the wearable mechanism. The piezoelectric driving device may include a vibration plate having first and second surfaces and a vibration structure disposed on at least one of the first and second surfaces of the vibration plate. The vibration structure may include a piezoelectric substance and first and second electrodes that interpose the piezoelectric substance. In the driving device according to this aspect of the invention, the actuator can be configured to have a simple, miniature, and thin structure, and thus the driving device can be miniaturized and thinned.

The aspects of the invention can be implemented in various forms such as a driving method of driving the driving device as well as the driving device.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
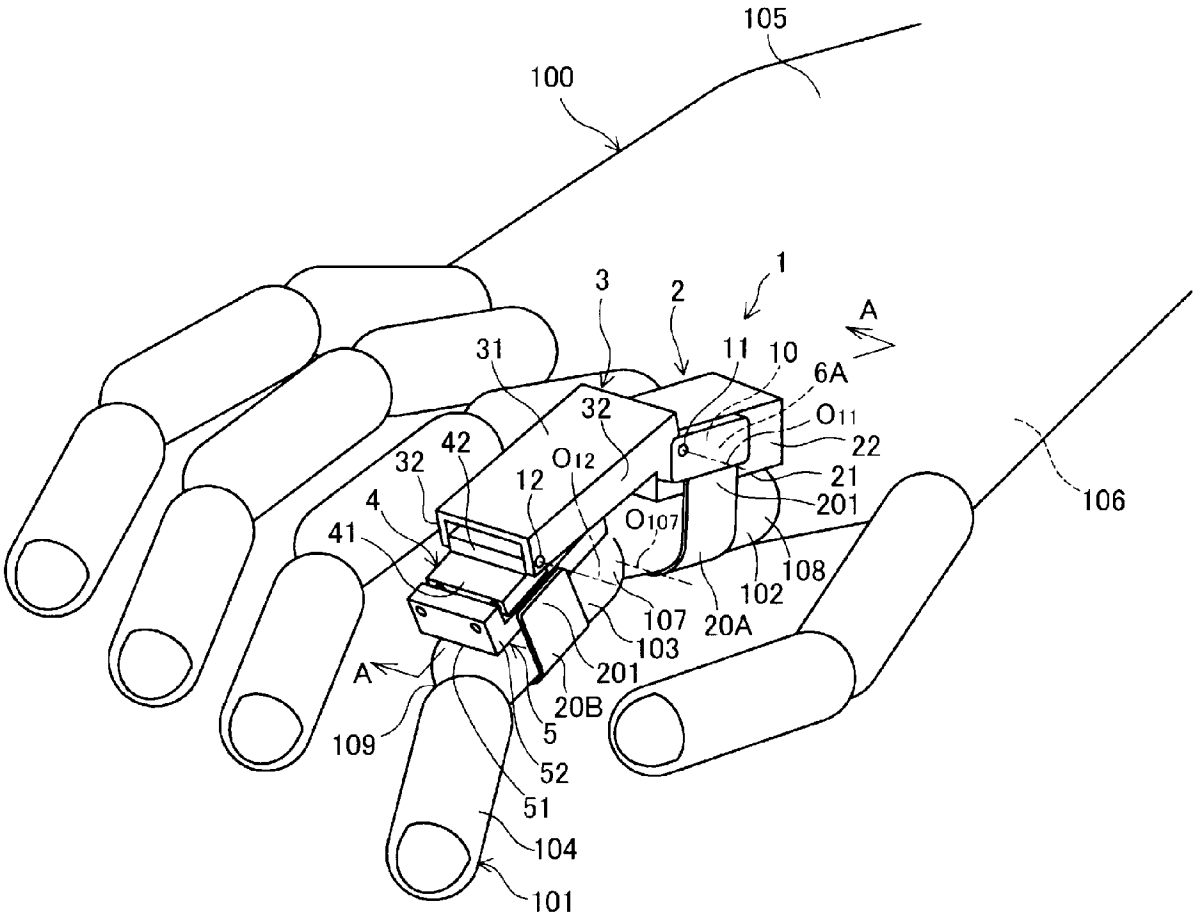
FIG. 1 is a perspective view illustrating a use state of a finger joint driving device according to a first embodiment.

Hereinafter, examples of a finger joint driving device worn on fingers which are wearing parts to support (assist) bending or spreading movements of the fingers will be described as a driving device according to the invention. In embodiments to be described below, the same reference numerals are given to members with the same configurations and the description thereof will be sometimes omitted or simplified.

A. First Embodiment

Figure 2:
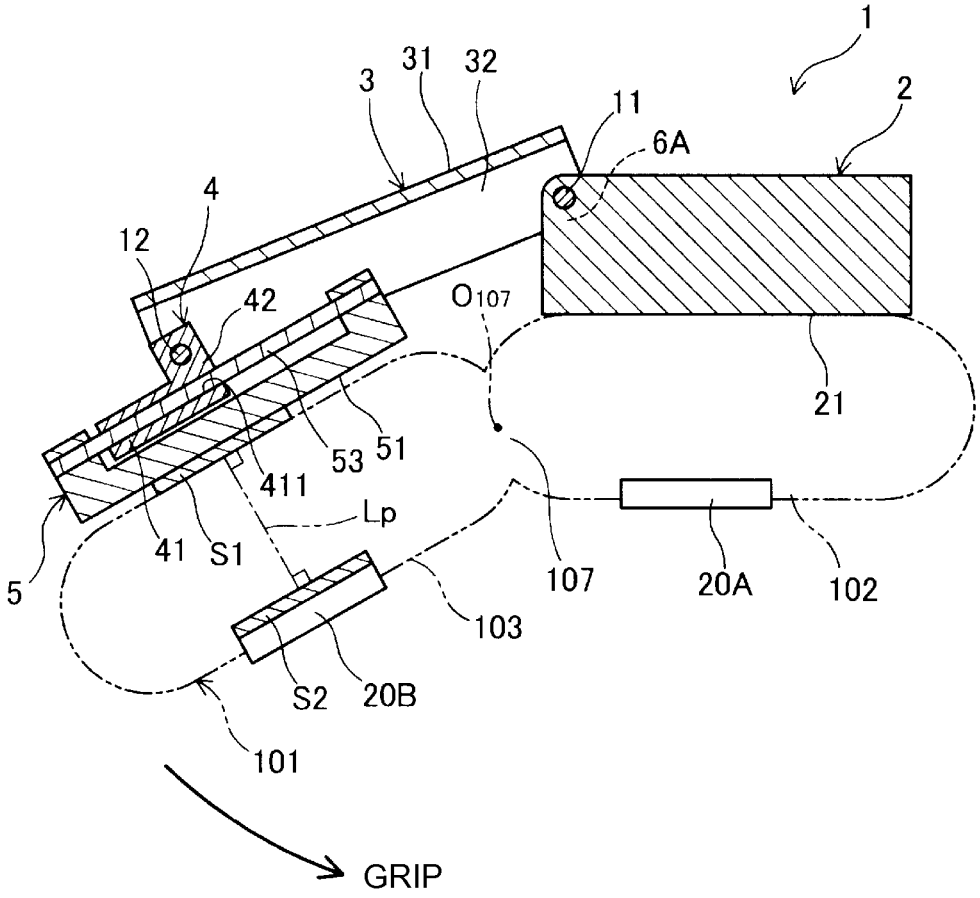
FIG. 2 is a sectional view taken along the line A-A of FIG. 1.
Figure 3:
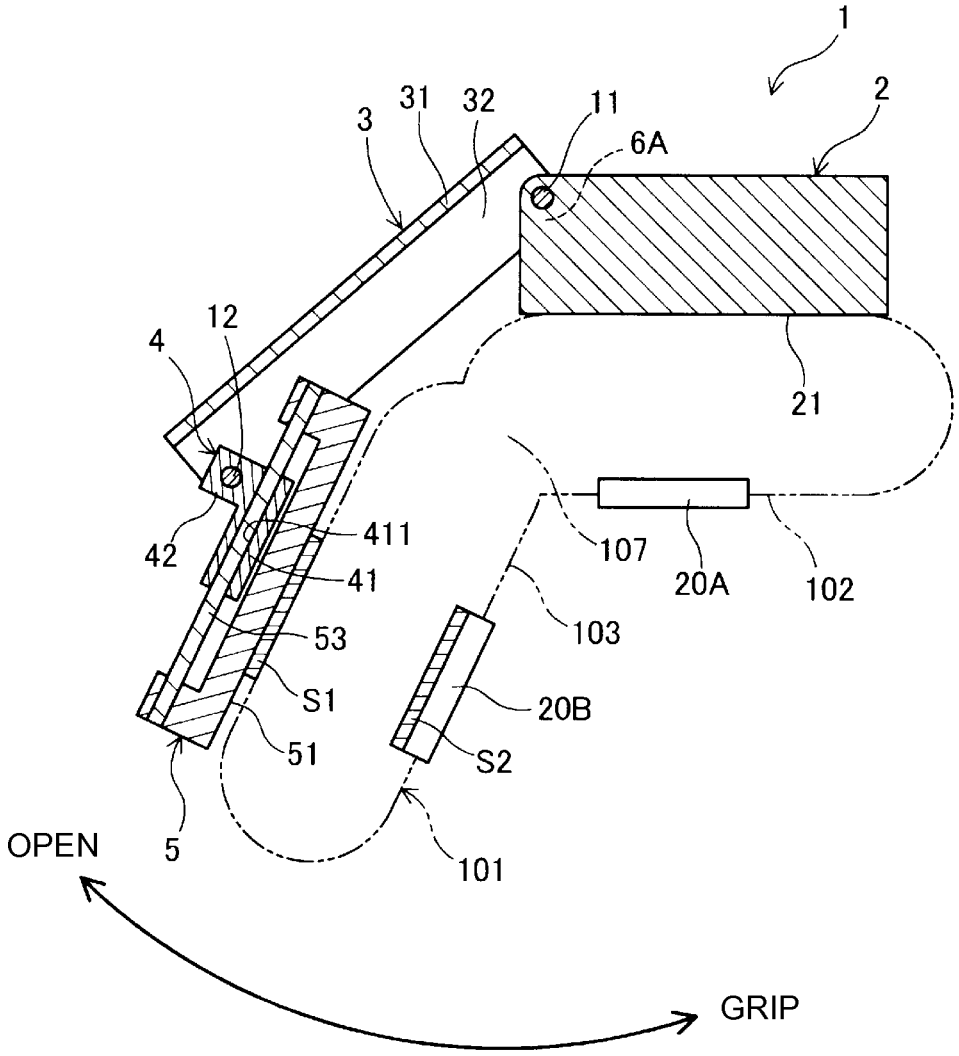
FIG. 3 is a sectional view illustrating a state in which a finger is bent from the state illustrated in FIG. 2.

FIG. 1 is a perspective view illustrating a use state of a finger joint driving device 1 according to a first embodiment. FIG. 2 is a sectional view taken along the line A-A of FIG. 1. FIG. 3 is a sectional view illustrating a state in which a finger is bent from the state illustrated in FIG. 2.

The finger joint driving device 1 is assumed to be worn on a hand 100 of, for example, a person for which trouble occurs in bending or spreading of fingers due to an accident, illness, or the like, a person of which a grip force becomes weak, or an aged person of which a force becomes weak due to aging. In the embodiment, the finger joint driving device 1 is worn on an index finger 101 and is used to assist flexing and stretching (that is, rotation) of the finger joints of the index finger 101. The finger joint driving device 1 includes a first base portion 2, a first link portion 3, a second link portion 4, and a second base portion 5. These members are connected in order from the wrist side to the finger tip side. These four members 2 to 5 are referred to as a "first member 2," a "second member 3," a "third member 4," and a "fourth member 5." As illustrated in FIG. 1, the finger joint driving device 1 further includes an actuator 6A and a control unit 10.

The first base portion 2 is disposed on the side of a hand back 105 of a proximal joint part 102 of the index finger 101 in the wearing state. The first base portion 2 is a member which has a block form of which the outside appearance is flat. The first base portion 2 is worn on the proximal joint part 102 of the index finger 101 using a first wearing band 20A. The first wearing band 20A is configured as a band body of which a length can be adjusted. Each end 201 is fixed to each side surface 22 of the first base portion 2. The first wearing band 20A is wrapped on the side of a hand palm 106 of the proximal joint part 102 of the index finger 101, that is, on the rear of the sheet surface of FIG. 1, the first base portion 2 comes into close contact with the proximal joint part 102, so that the first base portion 2 is not detached from the proximal joint part 102.

The second base portion 5 is disposed on the side of the finger tip side from the first base portion 2, that is, the side of the hand back 105 of a middle joint part 103 of the index finger 101. The second base portion 5 is a member with has a block form of which the outside appearance is flat. The second base portion 5 is worn on the middle joint part 103 of the index finger 101 using a second wearing band 20B, as in the first base portion 2.

The first link portion 3 is provided on the finger tip side of the first base portion 2. The first link portion 3 is a member of which a whole length is longer than the whole length of the first base portion 2 or the second base portion 5. The first link portion 3 includes a top plate 31 and side walls 32 protruding from both edges of the top plate 31. The first base portion 2 is interposed between the two side walls 32. Each side wall 32 and a side surface 22 of the first base portion 2 are connected to each other via a rotation support portion 11. The rotation support portion 11 is configured to have a shaft (not illustrated) which is installed in one of the side wall 32 and the first base portion 2 and a bearing (not illustrated) which is installed in the other thereof and into which the shaft is inserted. When a rotation axis $O_{107}$ is assumed at the time of rotation by flexing and stretching of a proximal interphalangeal joint 107 between the proximal joint part 102 and the middle joint part 103 of the index finger 101, a rotation axis $O_{11}$ of the rotation support portion 11 is parallel to the rotation axis $O_{107}$. The first link portion 3 can be rotated around the rotation axis $O_{11}$ with respect to the first base portion 2 by the rotation support portion 11 with such a configuration.

The second link portion 4 is provided on the finger tip side of the first link portion 3. The second link portion 4 includes a sliding portion 41 that slides with respect to the second base portion 5 and a protrusion portion 42 that protrudes from the sliding portion 41.

As illustrated in FIGS. 2 and 3, the sliding portion 41 of the second link portion 4 is a portion that has a cylindrical shape with a hollow portion 411. A rail portion 53 of the second base portion 5 is inserted through the hollow portion 411. The entire length of the rail portion 53 is set to be sufficiently longer than the entire length of the sliding portion 41. The sliding portion 41 is guided by the rail portion 53 to slide so that the second base portion 5 relatively approaches the first base portion 2 and relatively recedes from the first base portion 2. FIG. 2 illustrates a state in which the second base portion 5 approaches the first base portion 2, that is, a state in which the proximal interphalangeal joint 107 is spread and the index finger 101 enters an open state. FIG. 3 illustrates a state in which the second base portion 5 recedes from the first base portion 2, that is, a state in which the proximal interphalangeal joint 107 is bent and the index finger 101 is bent.

The protrusion portion 42 of the second link portion 4 is inserted into two side walls 32 of the first link portion 3. The protrusion portion 42 and each side wall 32 are connected to each other via a rotation support portion 12. The rotation support portion 12 is configured to have a shaft (not illustrated) which is installed in one of the protrusion portion 42 and the side wall 32 and a bearing (not illustrated) which is installed in the other thereof and into which the shaft is inserted. A rotation axis $O_{12}$ of the rotation support portion 12 is parallel to the rotation axis $O_{107}$. As in the first link portion 3, the second link portion 4 can be rotated around the rotation axis $O_{12}$ parallel to the rotation axis $O_{107}$ by the rotation support portion 12 with such a configuration. Since the rotation axis $O_{11}$ and the rotation axis $O_{12}$ are each parallel to the rotation axis $O_{107}$, the proximal interphalangeal joint 107 can be easily flexed and stretched by the finger joint driving device 1 while an excessive force is prevented from being applied to the proximal interphalangeal joint 107.

The materials for the first base portion 2, the first link portion 3, the second link portion 4, and the second base portion 5 are not particularly limited. For example, various resin materials such as polyethylene or various metal materials such as aluminum can be used. The materials for the first wearing band 20A and the second wearing band 20B are not particularly limited. For example, various rubber materials such as silicon rubber can be used.

As illustrated in FIGS. 2 and 3, a first force sensor S1 is disposed on a surface 51 of the second base portion 5 on the dorsal side of the middle joint part 103 and a second force sensor S2 is disposed on the surface of the second wearing band 20B on the ventral side of the middle joint part 103. That is, the two force sensors, that is, the first force sensor S1 and the second force sensor S2, face each other with the middle joint part 103 interposed therebetween. The first force sensor S1 and the second force sensor S2 are preferably disposed to face in a direction in which the index finger 101 rotates. Specifically, when a straight line Lp binding the centers of the surfaces of the first force sensor S1 and the second force sensor S2 facing each other is assumed, the first force sensor S1 and the second force sensor S2 are preferably disposed at positions at which the straight line Lp is perpendicular to the rotation axis $O_{107}$ of the proximal interphalangeal joint 107 and is parallel to the rotation surface of the proximal interphalangeal joint 107. The reason why this disposition is preferable is, as will be described below, that a person intends to flex and stretch the index finger 101, moment components are removed from detected values of the two force sensors S1 and S2 in the flexing and stretching movements of the finger and it is easy to estimate the intention to flex and stretch the index finger 101 based on the detected values of the two force sensors S1 and S2. However, the invention is not limited to this disposition. The first force sensor S1 may be disposed on the dorsal side of the finger and the second force sensor S2 may be disposed on the ventral side of the finger.

The first force sensor S1 is a force sensor that detects a force applied from the surface 51 of the second base portion 5 to the dorsal side of the middle joint part 103 and a force applied from the dorsal side of the middle joint part 103 to the side of the surface 51 of the second base portion 5 when the rotation of the proximal interphalangeal joint 107 is assisted by the actuator 6A to be described below. The second force sensor S2 is a force sensor that detects a force applied from the ventral side of the middle joint part 103 to the side of the second wearing band 20B and a force applied from a gripping target (not illustrated) to the ventral side of the middle joint part 103 via the second wearing band 20B when the gripping target is gripped by the index finger 101. The detected values detected by the first force sensor S1 and the second force sensor S2 are used for the control unit 10 to control a movement of the actuator 6A. The control unit 10 controls a movement state of the actuator 6A based on the detected values detected by the first force sensor S1 and the second force sensor S2, specifically, a rotation state of the first link portion 3, so that the proximal interphalangeal joint (second joint) 107 is flexed and stretched.

Figure 4:
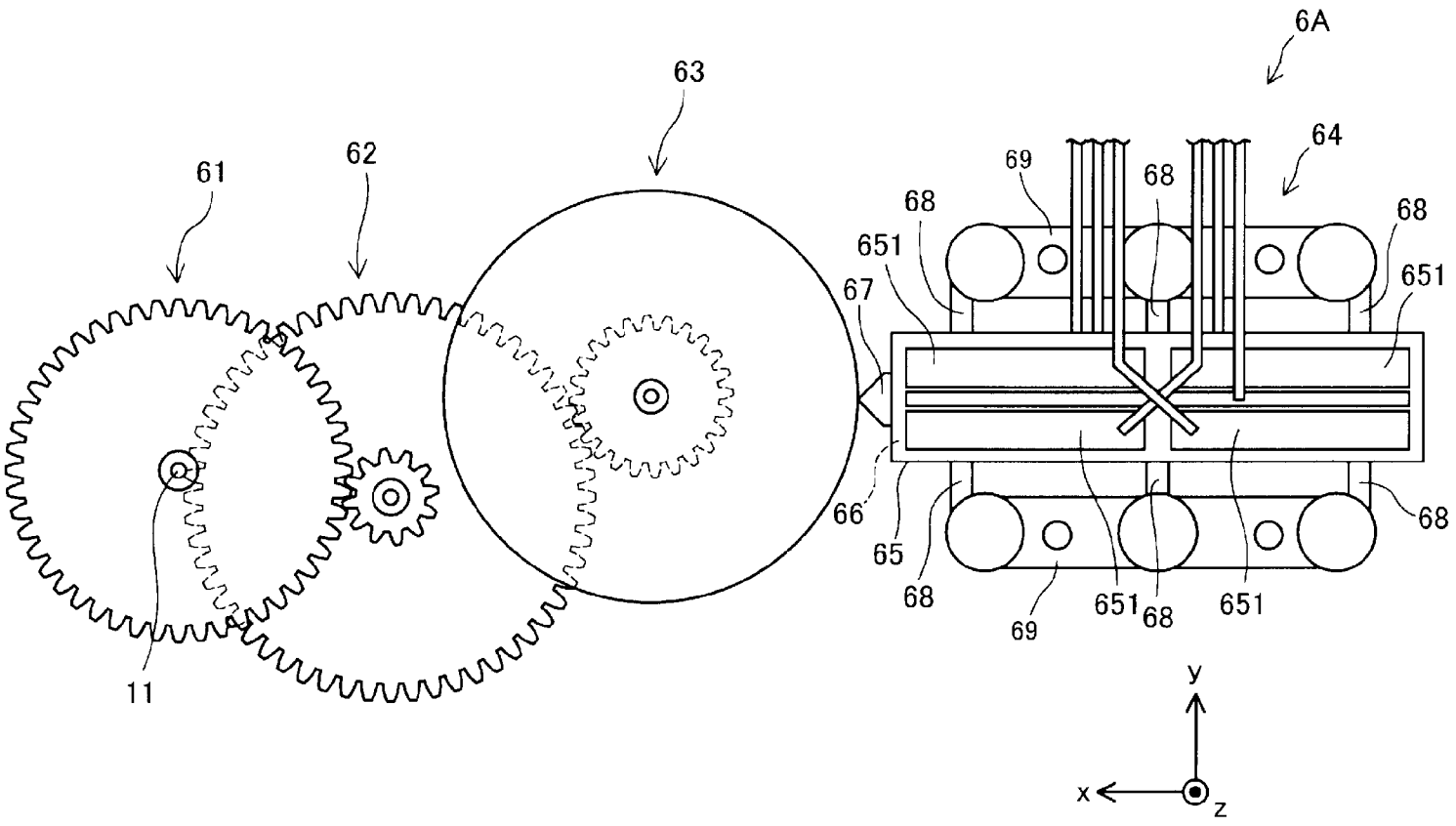
FIG. 4 is a diagram for describing an example of an actuator illustrated in FIG. 1.

FIG. 4 is a diagram for describing an example of the actuator 6A illustrated in FIG. 1. Hereinafter, to facilitate the description, the sheet front side of FIG. 4 is referred to as a "front side" and its opposite side is referred to as a "back side." The actuator 6A is a mechanism that applies a force to the shaft of the rotation support portion 11 when the first link portion 3 is rotated with respect to the first base portion 2. The actuator 6A includes a first rotor 61 that is connected concentrically to the shaft of the rotation support portion 11, a second rotor 62 that rotates the first rotor 61, a third rotor 63 that rotates the second rotor 62, and a piezoelectric drive device 64 that rotates the third rotor 63. The first rotor 61, the second rotor 62, and the third rotor 63 form a set of gear trains. Thus, when the third rotor 63 is rotated by the piezoelectric driving device 64, the first rotor 61 is accordingly rotated. The shaft of the rotation support portion 11 is rotated according to the rotation of the first rotor 61 and the first link portion 3 is accordingly rotated with respect to the first base portion 2.

The piezoelectric driving device 64 is a laminate that includes two sets of vibration structures 65 including five piezoelectric elements 651 and a vibration plate 66 inserted to be laminated between the vibration structures. The vibration structure is also referred to as a "vibrator."

Each of the five piezoelectric elements 651 of the vibration structures 65 includes a piezoelectric substance and first and second electrodes that interpose the piezoelectric substance (none of which is illustrated). One of the first and second electrodes may serve as a common electrode. The piezoelectric elements 651 are electrically connected to the control unit 10 (see FIG. 1). At least one piezoelectric element 651 included in the vibration structure 65 and various numbers or the disposition of the piezoelectric elements 651 may be used. The vibration structure 65 may be provided on at least one of two surfaces (first and second surfaces) of the vibration plate 66.

A protrusion 67 is provided at an end of the piezoelectric driving device 64. On both side surfaces of the piezoelectric driving device 64, a plurality of support portions 68 supporting the piezoelectric driving device 64 are provided at positions corresponding to a vibrating joint. These support portions 68 are integrated with the vibration plate 66. The plurality of support portions 68 protruding from the same side surface of the vibration plate 66 are preferably connected via a connection plate 69.

Figure 5A:
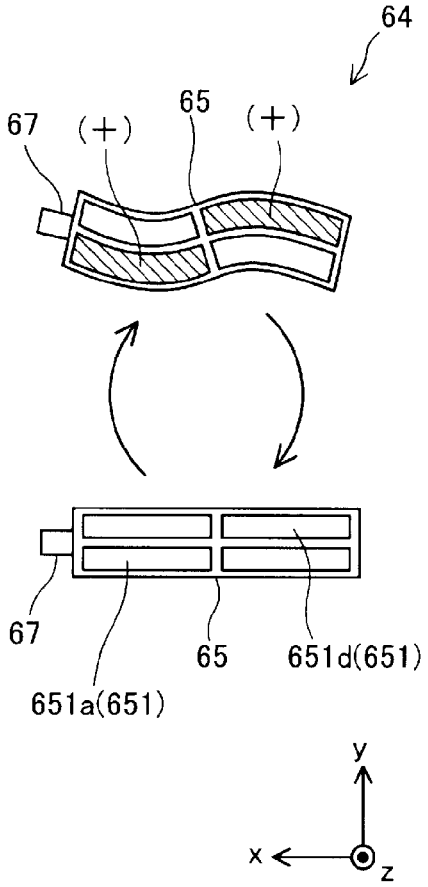
FIGS. 5A and 5B are diagrams for describing a movement principle of a piezoelectric driving device.
Figure 5B:
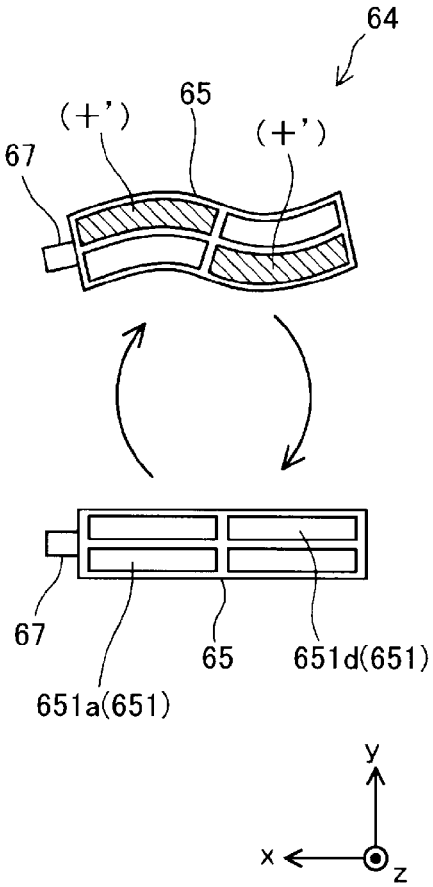

FIGS. 5A and 5B are diagrams for describing a movement principle of the piezoelectric driving device 64. When a voltage is applied to the piezoelectric elements 651 of each piezoelectric driving device 64 at a given period, the piezoelectric driving device 64 operates by expansion and contraction or an elliptical movement of the protrusion 67 of the piezoelectric driving device 64. As illustrated in FIG. 5A, two piezoelectric elements 651 located mutually at diagonal positions are configured as one set. Then, when a voltage with a specific frequency is applied, the piezoelectric driving device 64 is bent and deformed in a meandering form (S form) and the front end of the protrusion 67 reciprocates or moves elliptically in a specific direction. As a result, the third rotor 63 (see FIG. 4) coming into contact with the protrusion 67 rotates in a predetermined direction. As illustrated in FIG. 5B, when a voltage with a specific frequency is applied to the other set of piezoelectric elements 651, the third rotor 63 rotates in the opposite direction. Such a movement of the piezoelectric driving device 64 (or the vibration structure 65) is disclosed in the related technical document (JP-A-2004-320979 or the corresponding U.S. Pat. No. 7,224,102) and the disclosed content is incorporated by reference.

Thus, in the finger joint driving device 1, the rotation of the first link portion 3 can be reliably performed using the piezoelectric driving device 64. Further, the piezoelectric driving device 64 can contribute to realization of miniaturization or thinness of the finger joint driving device 1.

The control unit 10 (see FIG. 1) controls the movement of the actuator 6A based on a program stored in advance. As will be described below, the movement of the actuator 6A is controlled according to the detected values detected by the first force sensor S1 and the second force sensor S2. The control unit 10 is built into, for example, the second link portion 4 along with a battery (not illustrated) such as a button battery. The configuration of the control unit 10 is not particularly limited, but may be implemented as, for example, a dedicated circuit or a circuit configuration in which a microprocessor and a memory are included.

A movement of the finger joint driving device 1 with the above-described configuration will be schematically described. For the finger joint driving device 1, in the state illustrated in FIG. 2, the first base portion 2 is worn on the proximal joint part 102 of the index finger 101 and the second base portion 5 is worn on the middle joint part 103. When the actuator 6A operates from this state to rotate the first link portion 3 with respect to the first base portion 2, as illustrated in FIG. 3, the first link portion 3 and the second link portion 4 can be rotated counterclockwise in the drawing. Thus, the middle joint part 103 of the index finger 101 is pressed in a rightward obliquely downward direction in FIG. 3 with the second base portion 5. As a result, the proximal interphalangeal joint 107 of the index finger 101 is bent so that the index finger 101 can be moved in a gripping direction. When the first link portion 3 is rotated clockwise from the state illustrated in FIG. 3, the middle joint part 103 of the index finger 101 is pulled in a leftward obliquely upward direction in the drawing with the second base portion 5, as illustrated in FIG. 2. As a result, the proximal interphalangeal joint 107 of the index finger 101 is spread and the index finger 101 can be acted in an opening direction. When the proximal interphalangeal joint 107 is bent (or spread), the second base portion 5 recedes (or approaches) from the first base portion 2. However, as described above, the second link portion 4 and the second base portion 5 can move relatively. Therefore, the recession (or approach) of the second base portion 5 from the first base portion 2 is performed swiftly and smoothly. Thus, the proximal interphalangeal joint 107 can be easily bent, thereby reducing a burden on the index finger 101.

The wearer (user) of the finger joint driving unit 1 can flex and stretch a distal interphalangeal joint 109 or his or her thumb, middle finger, ring finger, or little finger of the index finger 101 (see FIG. 1) independently from the proximal interphalangeal joint 107 of the index finger 101 without the assistance of the finger joint driving device 1.

In the finger joint driving unit 1 in the wearing state, the first base portion 2 is disposed in the proximal joint part 102 of the index finger 101 and the second base portion 5 is disposed in the middle joint part 103 in the embodiment, but the invention is not limited to this disposition. For example, in the wearing state, the first base portion 2 may be disposed on the hand back 105 and the second base portion 5 may be disposed in the proximal joint part 102 of the index finger 101. In this case, a metacarpophalangeal joint (third joint) 108 can be flexed and stretched by the finger joint driving unit 1. Further, in the wearing state, the first base portion 2 may be disposed in the middle joint part 103 of the index finger 101 and the second base portion 5 may be disposed in a distal joint part 104. In this case, the distal interphalangeal joint (first joint) 109 can be flexed and stretched by the finger joint driving unit 1. In the wearing state, the first base portion 2 may be disposed in the middle joint part 103 of the index finger 101 and the second base portion 5 may be disposed on the opposite side to the finger tip from the first base portion 2, that is, in the proximal joint part 102 on the wrist side. In this case, as in the wearing state of the embodiment, the proximal interphalangeal joint 107 can be flexed and stretched by the finger joint driving unit 1.

A part (wearing part) of the hand 100 on which the finger joint driving device 1 is worn is the index finger 101 in the embodiment, but the invention is not limited thereto. For example, the wearing part may be a thumb, a middle finger, a ring finger, or a little finger.

The actuator 6A serves to rotate the first link portion 3 in the embodiment, but the invention is not limited thereto. The actuator 6A may serve to rotate the second link portion 4. Even in this case, the second link portion 4 can be reliably rotated, thereby contributing to the realization of miniaturization or thinness of the finger joint driving device 1.

The first base portion (first member) 2, the first link portion (second member) 3, the second link portion (third member) 4, and the second base portion (fourth member) 5, the first wearing band 20A, and the second wearing band 20B correspond to a "wearable mechanism" according to the invention. The second base portion 5 corresponds to an "assistant portion" according to the invention, the second wearing band 20B corresponds to an "interposing portion," and the second base portion 5 and the second wearing band 20B correspond to "assistant units."

Figure 6:
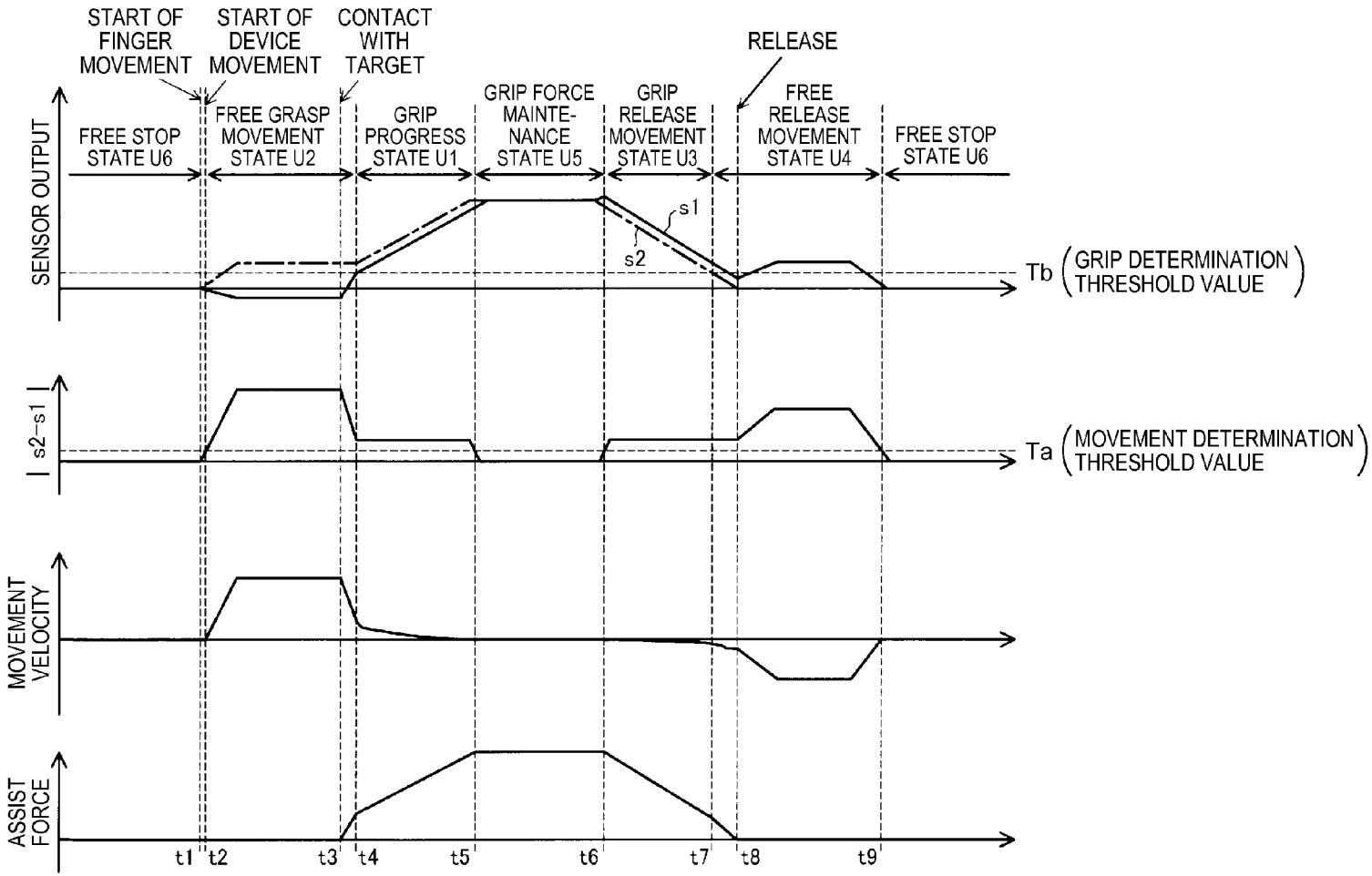
FIG. 6 is a diagram for describing an example of the control of the movement of the actuator performed according to detected values of first and second force sensors in a control unit.

FIG. 6 is a diagram for describing an example of the control of a movement of the actuator 6A performed according to detected values of the first force sensor S1 and the second force sensor S2 in the control unit 10. FIG. 6 illustrates changes in various parameters in a series of movements in which the wearer (user) of the finger joint driving unit 1 grips a gripping target with the hand 100 and then opens the hand 100 to separate the gripping target. An output (detected value: s1) of the first force sensor S1, an output (detected value: s2) of the second force sensor S2, an absolute value |s1−s2| of a difference between the outputs of the force sensors, a movement velocity (rotation velocity) of the first link portion 3, and an assist force (hereinafter also referred to as a "grip force") provided by the actuator 6A are shown as the parameters. Hereinafter, a state in which a gripping target is not gripped is also referred to as a "free (state)" and a state in which a gripping target is gripped is also referred to as a "grip (state)."

At a start time point of FIG. 6, the hand 100 is in a free stop state in which the hand 100 grips nothing and a movement state of the finger joint driving unit 1 is a "free stop state U6." In this case, the outputs of the first force sensor S1 and the second force sensor S2 are zero. Actually, pressure from the wearing bands is related to the force sensors S1 and S2 at the time of wearing. However, it is here assumed that such pressure is calibrated and the output becomes "0". Hereinafter, a force applied from pressure when the pressure at the time of calibration is a criterion is referred to as a "positive force" and a force reduced from a pressure is referred to as a "negative force." At time t1, the wearer starts moving in a direction in which the index finger 101 is bent, and the outputs of the first force sensor S1 and the second force sensor S2 are changed. Specifically, the output of the first force sensor S1 is temporarily decreased and the output of the second force sensor S2 is increased. Then, at time t2, the assist of the first link portion 3 by the actuator 6A starts at a time point at which an output difference |s1−s2| is equal to or greater than a movement determination threshold value Ta. A movement state of the finger joint driving device 1 from time t2 is referred to as a "free grasp movement state U2." In the free grasp movement state U2, a positive force is applied to the second force sensor S2 and a negative force is applied to the first force sensor S1. At this time, the actuator 6A rotates the first link portion 3 at a movement velocity according to the output difference |s1−s2| so that the index finger 101 is bent and the grip of the hand 100 is assisted.

Then, at time t3, when the index finger 101 comes into contact with a gripping target, a positive force applied according to the extent that the index finger 101 grips the gripping target is applied to the second force sensor S2 and a positive force is also applied to the first force sensor S1 from the dorsal side of the middle joint part 103, and thus the output difference |s1−s2| is decreased. At this time, the rotation velocity of the first link portion 3 is decreased. However, with the decrease in the rotation velocity, a force (torque) driving the first link portion 3 by the actuator 6A increases to enhance a grip force of the index finger 101. Then, a movement state of the finger joint driving device 1 from a time point at which the output of the first force sensor S1 is equal to or greater than a grip determination threshold value Tb at time t4 is assumed to be a "grip progress state U1" in which the gripped gripping target is further gripped tightly. At this time, the movement velocity of the first link portion 3 by the actuator 6A is further decreased toward "0" in a considerably small state, but a force (torque) driving the first link portion 3 by the actuator 6A is further increased. Then, at a time point at which the output difference |s1−s2| is less than the movement determination threshold value Ta at time t5, the movement state of the finger joint driving device 1 becomes a state in which the grip force of the gripping target is maintained. This state is referred to as a "grip force maintenance state U5." In this state, the output of the first force sensor S1 is substantially the same as the output of the second force sensor S2, a constant assist force is applied by the finger joint driving device 1, and the gripping target is gripped by a constant grip force with the hand 100.

At the end of the grip force maintenance state U5, when the wearer starts a movement of opening the hand 100, the output of the second force sensor S2 is less than the output of the first force sensor S1 and decreases. At time t6, the output difference |s1−s2| is equal to or greater than the movement determination threshold value Ta. From here, the movement state of the finger joint driving device 1 becomes a "grip release movement state U3" in which a movement of opening the hand 100 and separating the gripping target from the hand 100 starts, from the grip force maintenance state U5. In this case, the movement velocity of the first link portion 3 by the actuator 6A gradually increases from "0" and the assist force accordingly decreases. Then, the opening of the hand 100 becomes large, the outputs of the first force sensor S1 and the second force sensor S2 decrease, and the movement state of the finger joint driving device 1 becomes a "free release movement state U4" from a time point at which the output of the second force sensor S2 is less than the grip determination threshold value Tb at time t7. Then, the gripping target is actually released at a time point when the output of the second force sensor S2 becomes "0" at time t8, the hand 100 actually becomes free, and the assist force becomes "0." In the free release movement state U4, a positive force is applied to the first force sensor S1 with the movement of opening the hand 100. At this time, the actuator 6A rotates the first link portion 3 at a movement velocity according to the output difference |s1−s2|, so that the rotation of the proximal interphalangeal joint 107 is assisted, the spreading of the index finger 101 is assisted, and the opening of the hand 100 is assisted.

Then, immediately before the movement in which the wearer opens the hand 100 stops, the output of the first force sensor S1 also decreases and the output difference |s1−s2| is less than the movement determination threshold value Ta at time t9. At this time, the movement state of the finger joint driving device 1 returns to the "free stop state U6" in which the movement in which the wearer opens the hand 100 stops. The movement of the finger joint driving device 1 illustrated in FIG. 6 is performed when the control unit 10 performs a control process to be described below according to the outputs of the first force sensor S1 and the second force sensor S2.

Figure 7:
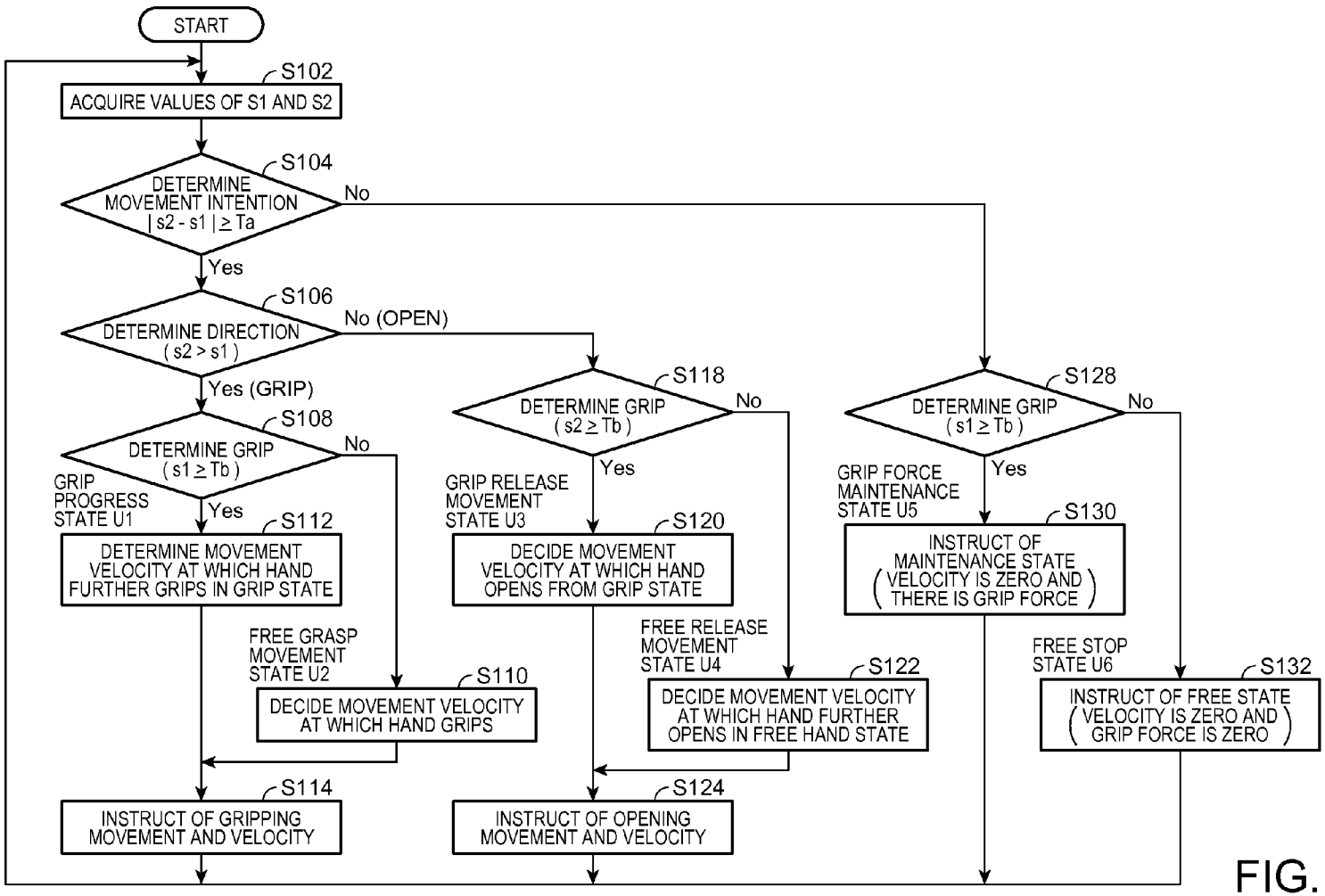
FIG. 7 is a flowchart illustrating a control process performed by the control unit according to outputs of the first and second force sensors.

FIG. 7 is a flowchart illustrating the control process performed by the control unit 10 according to the outputs of the first force sensor S1 and the second force sensor S2. The control flow is repeatedly performed until the power of the finger joint driving device 1 is turned off after the power is activated.

First, in step S102, the values of the outputs of the first force sensor S1 and the second force sensor S2 are acquired. In step S104, whether the wearer has a movement intention is determined. Specifically, whether the wearer has the movement intention is determined depending on whether the output difference |s1−s2| between the first force sensor S1 and the second force sensor S2 is equal to or greater than the movement determination threshold value Ta. For example, at time t2 and time t6 of FIG. 6, it is determined that the wearer has the movement intention. At time t5 and time t9 of FIG. 6, it is determined that the wearer has no movement intention. The value of the movement determination threshold value Ta is confirmed and set in advance experimentally in consideration of, for example, prevention of an erroneous movement or determination possibility of a movement intention of the wearer. As will be described below, when it is determined that the wearer has the movement intention, the processes of steps S106 to S124 are performed. When it is determined that the wearer has no movement intention, the processes of steps S128 to S132 are performed.

When it is determined in step S104 that the wearer has the movement intention, the output of the first force sensor S1 is subsequently compared to the output of the second force sensor S2 and a movement direction intended by the wearer is determined in step S106. As will be described, when the output of the second force sensor S2 is greater than the output of the first force sensor S1, the movement direction is determined to be a hand gripping direction (finger bending direction) and the processes of steps S108 to S114 are performed. When the output of the second force sensor S2 is equal to or less than the output of the first force sensor S1, the movement direction is determined to be a hand opening direction (finger spreading direction) and the processes of steps S118 to S124 are performed.

When the movement direction is determined to be the hand gripping direction, it is determined in step S108 whether the output of the first force sensor S1 is equal to or greater than the grip determination threshold value Tb. Here, when it is determined that the output of the first force sensor S1 is less than the grip determination threshold value Tb, the movement state of the finger joint driving device 1 becomes the free grasp movement state U2 (see FIG. 6). In step S110, the movement velocity at which the hand grips is decided according to the output difference |s1−s2|. Conversely, when it is determined that the output of the first force sensor S1 is equal to or greater than the grip determination threshold value Tb, the movement state of the finger joint driving device 1 becomes the grip progress state U1 (see FIG. 6). In step S112, the movement velocity at which the hand further grips in the grip state is decided according to the output difference |s1−s2|. Then, in step S114, the actuator 6A is instructed of a movement in which the hand grips at the decided movement velocity and the actuator 6A rotates the first link portion 3 at the instructed movement velocity.

Conversely, when it is determined in step S106 that the movement direction is the hand opening direction, the output of the second force sensor S2 is equal to or greater than the grip determination threshold value Tb in step S118 as in step S108. Here, when it is determined that the output of the second force sensor S2 is equal to or greater than the grip determination threshold value Tb, the movement state of the finger joint driving device 1 becomes the grip release movement state U3 (see FIG. 6). In step S120, the movement velocity at which the hand opens from the grip state is decided according to the output difference |s1−s2|. Conversely, when the output of the second force sensor S2 is less than the grip determination threshold value Tb, the movement state of the finger joint driving device 1 becomes the free release movement state U4 (see FIG. 6). In step S122, a movement velocity at which the hand further opens in a free hand state is decided according to the output difference |s1−s2|. Then, as in step S114, in step S124, the actuator 6A is instructed of a movement in which the hand opens at the decided movement velocity and the actuator 6A rotates the first link portion 3 at the instructed movement velocity.

When it is determined in step S104 that the wearer has no movement intention, it is determined whether the output of the first force sensor S1 is equal to or greater than the grip determination threshold value Tb. Here, when it is determined that the output of the first force sensor S1 is equal to or greater than the grip determination threshold value Tb, the movement state of the finger joint driving device 1 is determined to be the grip force maintenance state U5 (see FIG. 6). Then, the actuator 6A is instructed to maintain the movement at a driving force generated at this time point and the actuator 6A maintains the driving state of the first link portion 3. Conversely, when the output of the first force sensor S1 is less than the grip determination threshold value Tb, the movement state of the finger joint driving device 1 is determined to be the free stop state U6 (see FIG. 6). Then, the actuator 6A is instructed of a free stop state and the actuator 6A stops the driving of the first link portion 3.

In the above-described control flow, the values of the outputs of the two force sensors S1 and S2 are acquired and the movement state of the finger joint driving device 1 is determined through the determination (whether there is an intention to move the hand) of the movement intention based on the acquired output values, the determination of the movement direction (the gripping/opening of the hand), and the gripping determination (grip/free). Specifically, the movement state of the finger joint driving device 1 is determined to be one of the grip progress state U1, the free grasp movement state U2, the grip release movement state U3, the free release movement state U4, the grip force maintenance state U5, and the free stop state U6. Then, the actuator 6A is allowed to drive the first link portion 3 so that the finger joint driving device 1 moves according to the movement state. Thus, the movement intention of the wearer is detected based on the outputs of the two force sensors S1 and S2 and the finger joint driving device 1 can be moved according to the movement intention. Thus, the hand 100 wearing the finger joint driving device 1, more specifically, the movement of the index finger 101, can be assisted. As understood from the above description, the movement determination threshold value Ta and the grip determination threshold value Tb correspond to the first threshold value and the second threshold value according to the invention.

Figure 8:
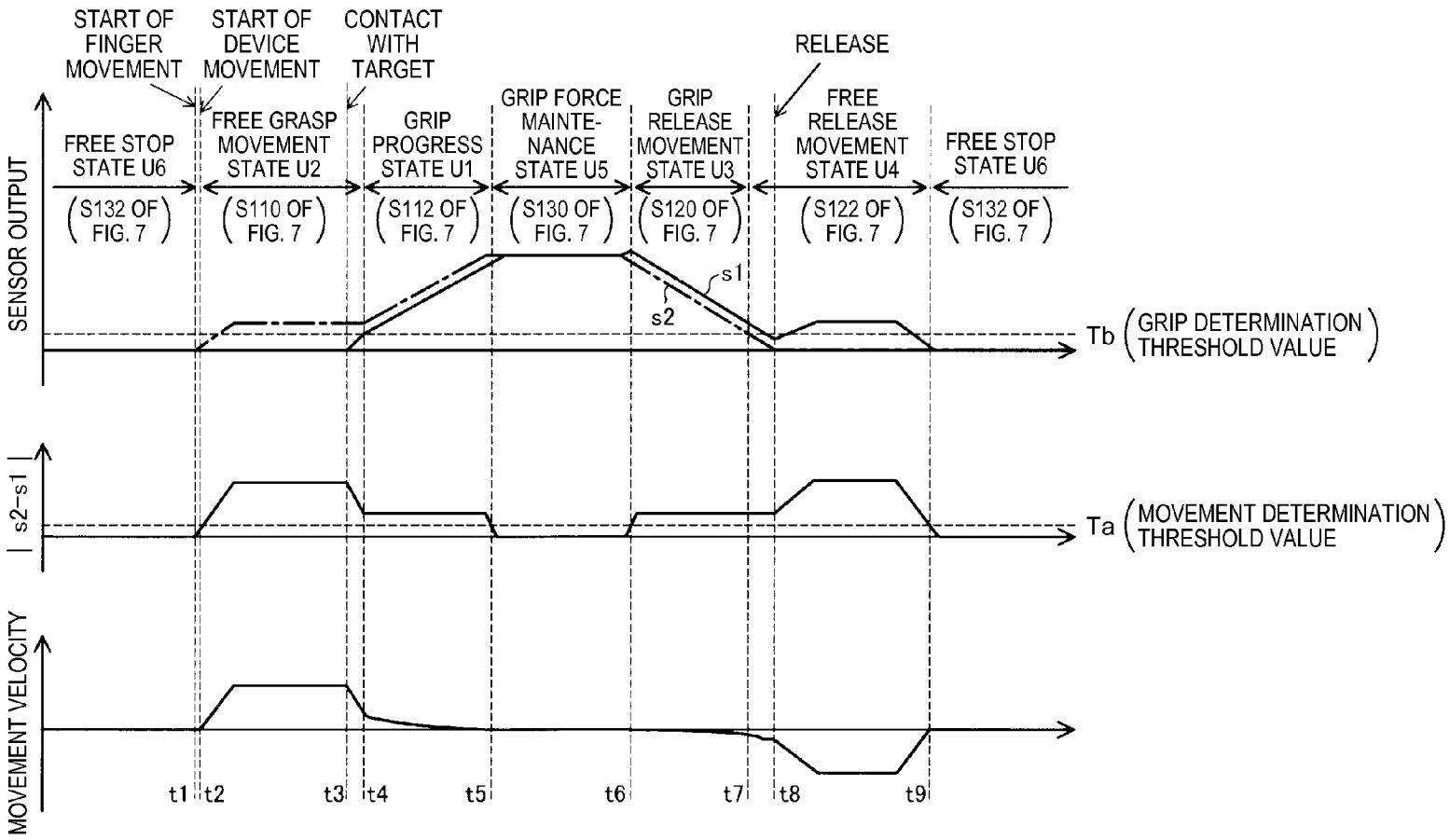
FIG. 8 is a diagram for describing another example of the control of the movement of the actuator performed according to detected values of the first and second force sensors in the control unit as in FIG. 6.

FIG. 8 is a diagram for describing another example of the control of the movement of the actuator 6A performed according to the detected values of the first force sensor S1 and the second force sensor S2 in the control unit as in FIG. 6. As described above, in the example of FIG. 6, the negative force is applied to the first force sensor S1 in the free grasp movement state U2 when the outputs of the first force sensor S1 and the second force sensor S2 become "0" by calibrating the detected values according to the pressure at the time of the wearing. On the other hand, in the example of FIG. 8, since a negative force applied to the first force sensor S1 is small to the negligible extent in a state in which no pressure is applied at the time of wearing or in the free grasp movement state U2 in which a pressure at the time of wearing is small, the output of the first force sensor S1 becomes "0" in the free grasp movement state U2. The others are the same as those of FIG. 6.

Figure 9:
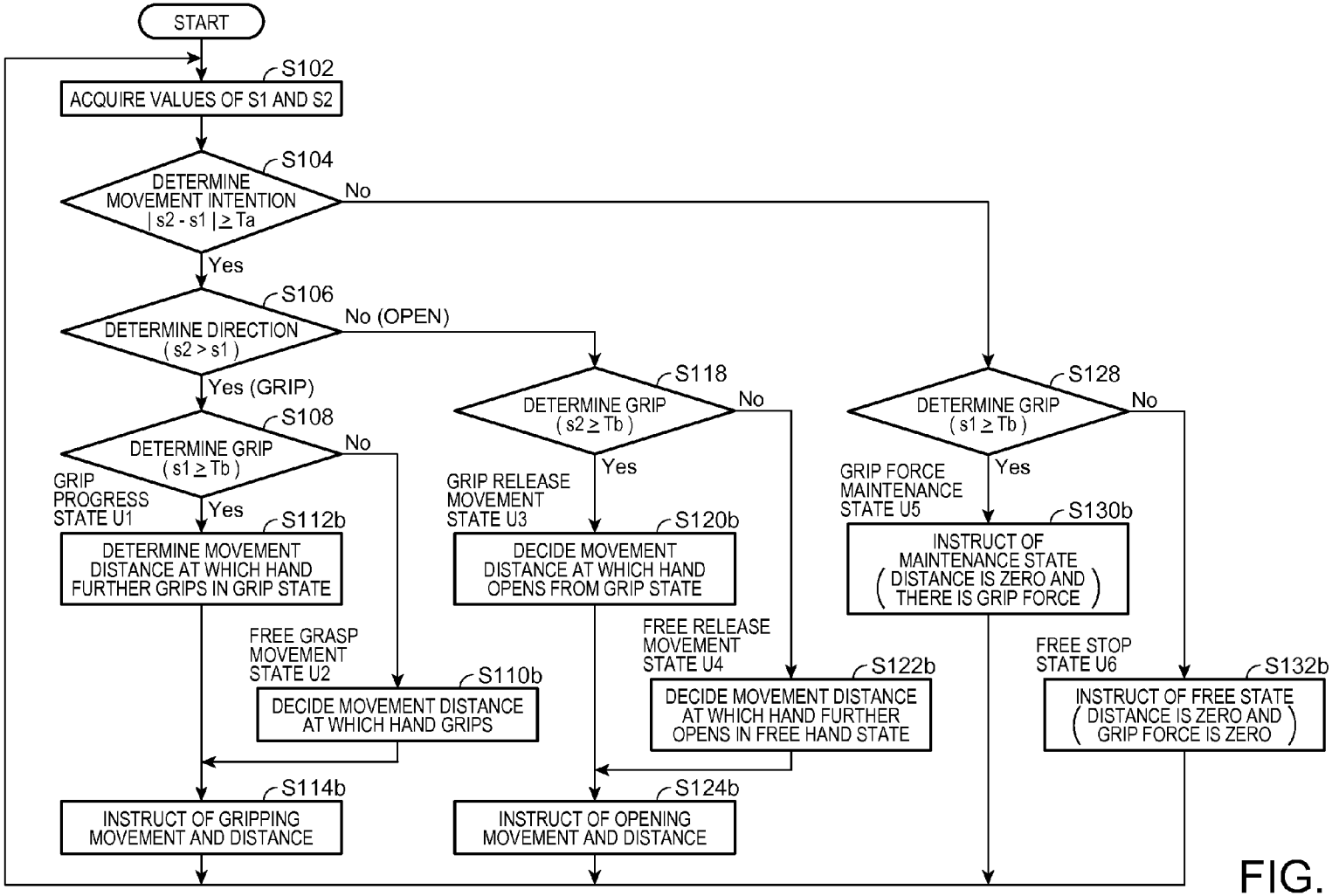
FIG. 9 is a diagram for describing a modification example of a control flow of FIG. 7.

FIG. 9 is a diagram for describing a modification example of the control flow of FIG. 7. In the control flow, a process of deciding a movement velocity according to each of the determined movement states is performed in steps S110, S112, S120, S122, S130, and S132 of the control flow of FIG. 7. On the other hand, in a control flow of FIG. 9, steps S110, S112, S120, S122, and S120 of the control flow of FIG. 7 are substituted with steps S110*b*, S112*b*, S120*b*, S122*b*, S130*b*, and S132*b* and a process of deciding a movement distance according to each of the determined movement states is performed. The parameter used to decide the driving amount of the first link portion 3 by the actuator 6A is the movement distance rather than the movement velocity. Likewise, even in this case, by detecting a movement intention of the wearer based on the outputs of the two force sensors, that is, the first force sensor S1 and the second force sensor S2, and moving the finger joint driving device 1 according to the movement intention, it is possible to assist the movement of the hand wearing the finger joint driving device 1, more specifically, the movement of the index finger 101, for example, as illustrated in FIG. 6.

The state in which a constant grip force is maintained in the grip force maintenance state U5 includes a state in which a grip force is changed within a constant change range so that the constant grip force is maintained. For example, this state may be a state in which a grip force is maintained to be constant as a whole while the outputs of the first force sensor S1 and the second force sensor S2 are changed using the state in which the constant grip force can be obtained as a criterion. As an assist force given by the actuator 6A in the grip force maintenance state U5, for example, the following various forces can be used.

(1) a constant force which is not temporally changed (2) a force which is changed periodically in a fluctuating manner but can constantly maintain a grip state (3) a force which is changed at random in a fluctuating manner but can constantly maintain a grip state Such forces have substantially the same operation in the sense that assisting is performed to stably grip a gripping target. Thus, a term "the constant force" in the present specification has a wide meaning of various forces such as the foregoing (1) to (3) in a broad sense. On the other hand, the phrase "the constant force that does not change temporally" has a narrow meaning including the foregoing (1) and including neither the foregoing (2) nor the foregoing (3). The width of the fluctuation of the force is preferably within, for example, ±0.001 N/mm$^2$. The grip force maintenance state U5 can be confirmed according to a method to be described below. When a force changes in a fluctuating manner, the detected values detected by the two force sensors S1 and S2 also change in a fluctuating manner in response to the change in the force.

Figure 10:
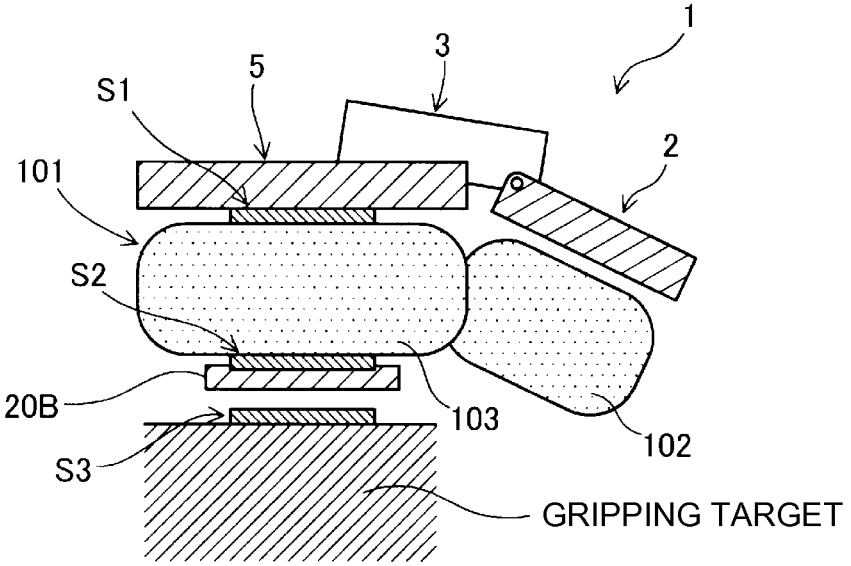
FIG. 10 is a diagram for describing a scheme of confirming a grip force maintenance state.

FIG. 10 is a diagram for describing a scheme of confirming the grip force maintenance state U5. FIG. 10 schematically illustrates the finger joint driving device 1 of the sectional view of FIG. 2 and a gripping target. As illustrated in FIG. 10, a gripping target is provided with a third force sensor S3 which is used as the same force sensor as the first force sensor S1 and the second force sensor S2. The third force sensor S3 is assumed to be provided on the surface of the gripping target facing the second force sensor S2 provided on the second wearing band 20B. By gripping the gripping target, it is possible to confirm the grip force maintenance state U5.

Figure 11:
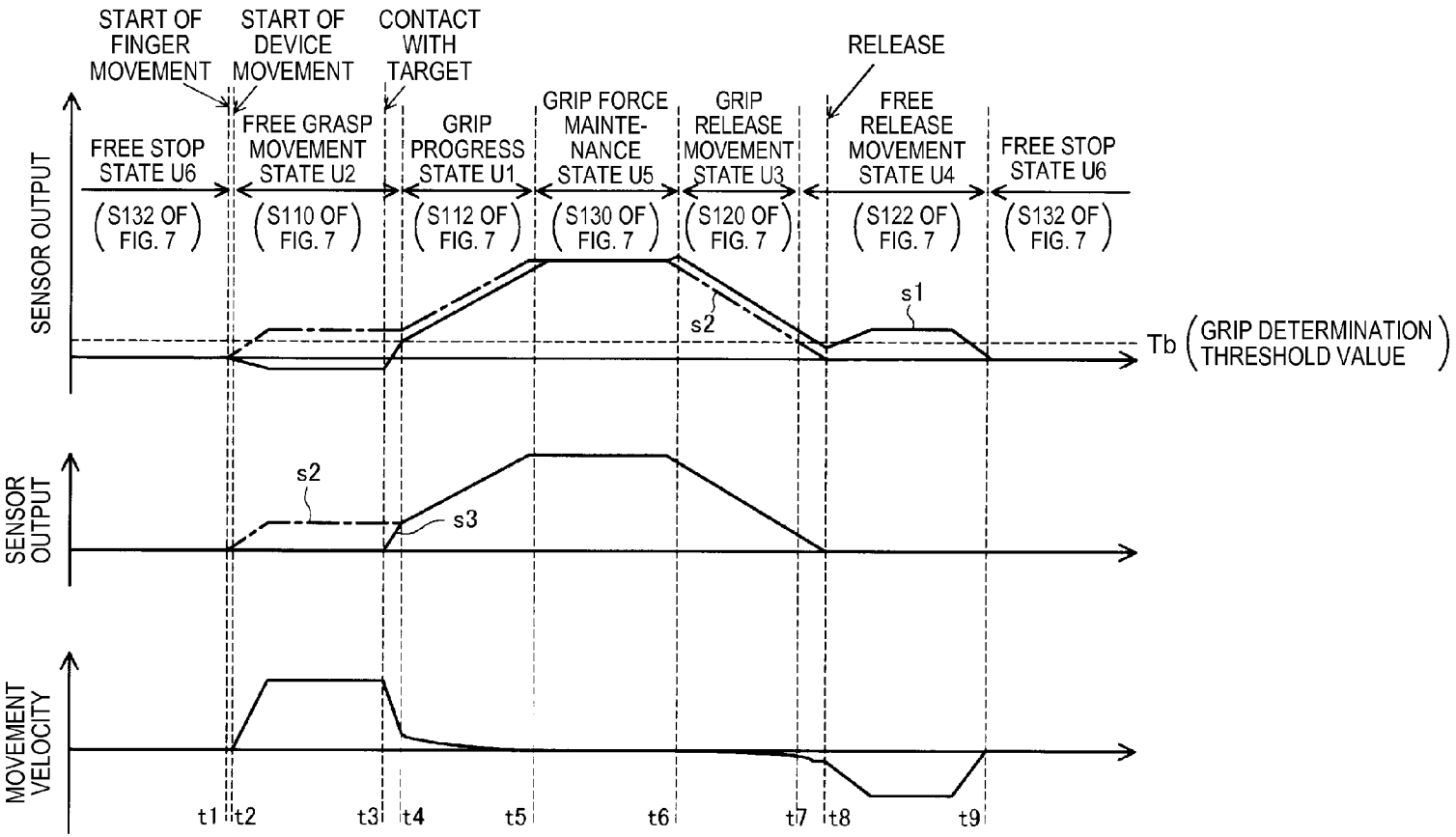
FIG. 11 is a diagram for describing another example of the control of the movement of the actuator performed according to detected values of the first and second force sensors in the control unit as in FIG. 6.

FIG. 11 is a diagram for describing another control example of the movement of the actuator 6A performed according to the detected values of the first force sensor S1 and the second force sensor S2 in the control unit as in FIG. 6. FIG. 11 shows changes in various parameters in a series of movements in which the wearer of the finger joint driving unit 1 grips a gripping target having the third force sensor S3 with the hand 100 and then opens the hand 100 to separate the gripping target in the same order as the order of FIG. 6. The outputs of the first force sensor S1 and the second force sensor S2, the outputs (detected value: s3) of the second force sensor S2 and the third force sensor S3, and a movement velocity (rotation velocity) of the first link portion 3 are shown as the parameters.

As illustrated in FIG. 11, in the free grasp movement state U2 between time t2 and time t3, the output of the third force sensor S3 of the gripping target is "0." However, after contact with the gripping target at time t3, the output of the third force sensor S3 sharply increases in response to a state in which the gripping target is tightly gripped with the palm of the hand 100. Then, after the output of the first force sensor S1 is equal to or greater than the grip determination threshold value Tb at time t4 and the movement state becomes the grip progress state U1, the output of the third force sensor S3 increases in agreement with the output of the second force sensor S2 with which the third force sensor S3 comes into contact via the second wearing band 20B. Then, during time t5 to time t6 at which the movement state becomes the grip force maintenance state U5, the output of the third force sensor S3 is maintained constantly to have the same magnitude as the outputs of the second force sensor S2 and the first force sensor S1. Then, after the movement state becomes the grip release movement state U3 at time t6, the output of the third force sensor S3 decreases in agreement with the output of the second force sensor S2 according to the extent that the hand 100 opens and becomes "0" at a time point at which the gripping target is released at time t8.

As understood from the above description, by confirming the value (detected value) of the output of the third force sensor S3, it is possible to confirm that the grip force by the finger joint driving device 1 is maintained to have the constant magnitude in the grip force maintenance state U5.

B. Second Embodiment

Figure 12:
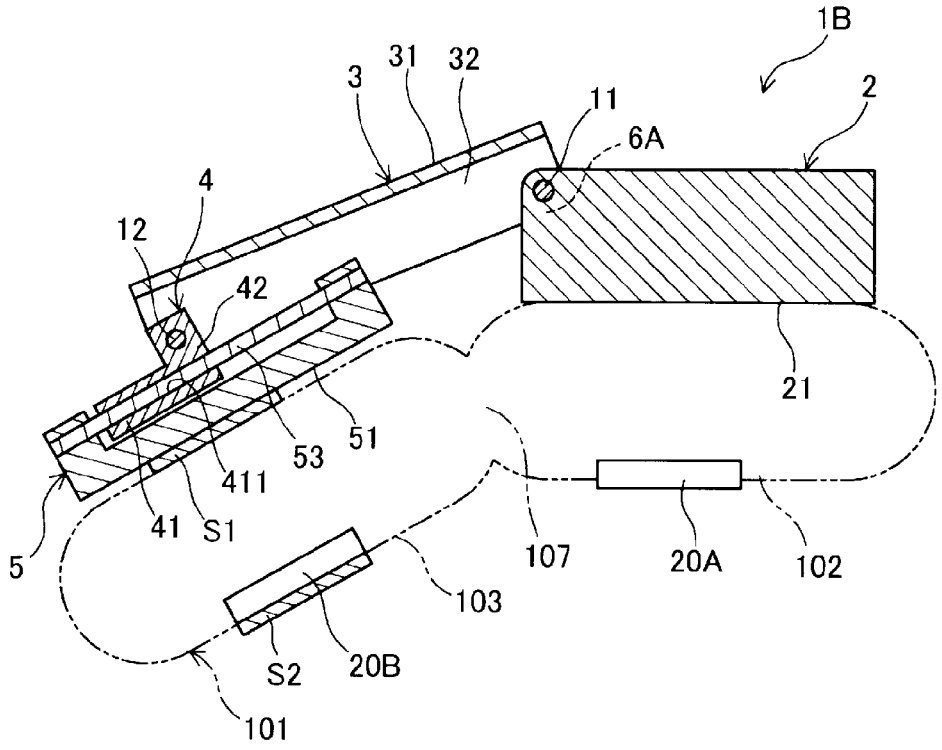
FIG. 12 is a sectional view illustrating a finger joint driving device according to a second embodiment.

FIG. 12 is a sectional view illustrating a finger joint driving device 1B a according to a second embodiment. FIG. 12 corresponds to the sectional view of the finger joint driving device 1 taken along the line A-A in the first embodiment illustrated in FIG. 2.

The finger joint driving device 1B according to the embodiment is different from the finger joint driving device 1 according to the first embodiment in that the second force sensor S2 is provided not on the surface of the second wearing band 20B facing the ventral side of the middle joint part 103 but on the surface of the second wearing band 20B opposite to the middle joint part 103. The finger joint driving device 1B according to the embodiment is different in a control operation performed by the control unit 10 according to a difference of the disposition of the second force sensor S2. The finger joint driving device 1B according to the embodiment is the same as the finger joint driving device 1 according to the first embodiment in the other points. Thus, description of only a control operation performed by the control unit 10 will be added.

Figure 13:
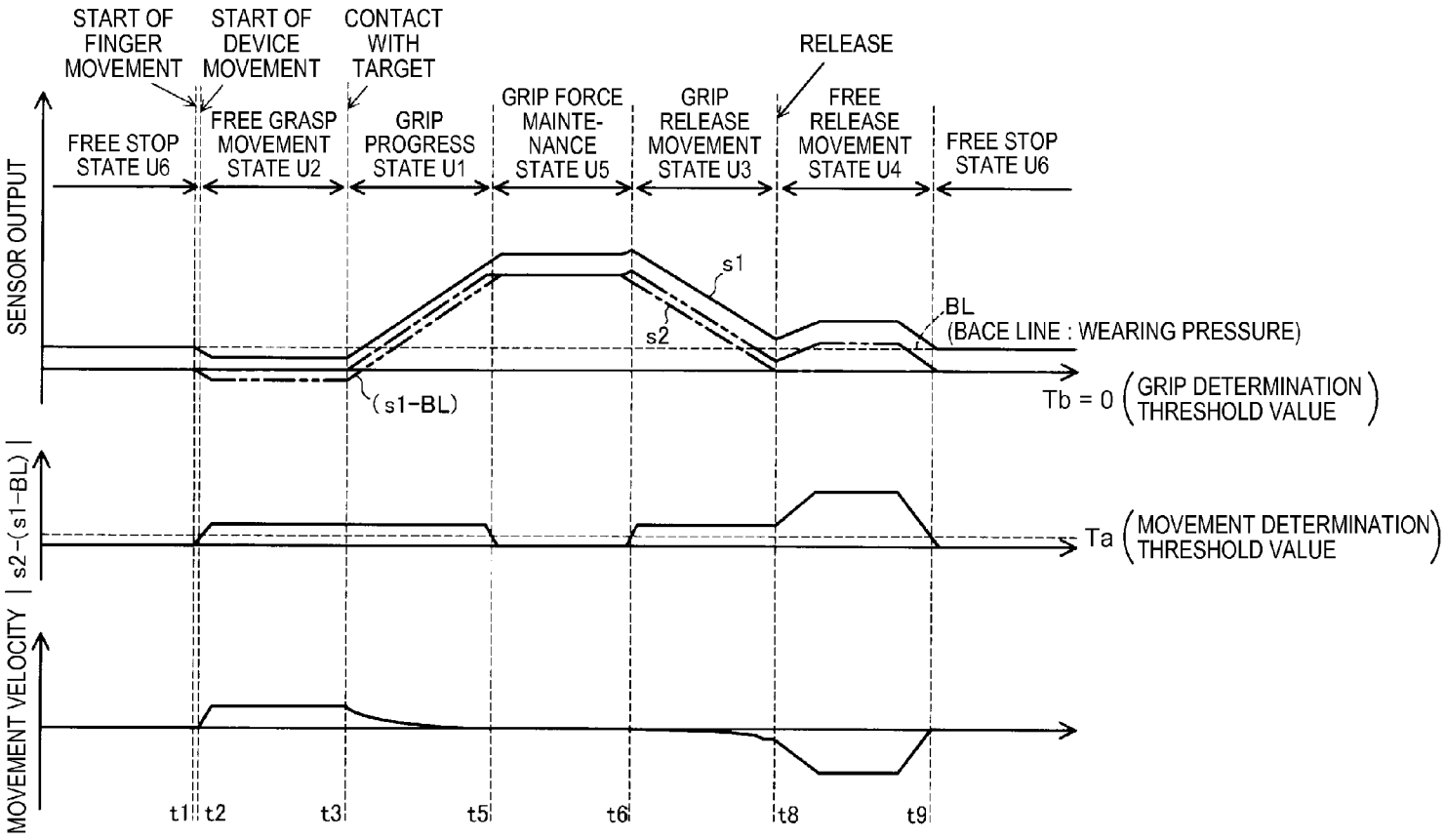
FIG. 13 is a diagram for describing a control example of the movement of the actuator performed according to detected values of first and second force sensors in the control unit.

FIG. 13 is a diagram for describing an example of the control of the movement of the actuator 6A performed according to detected values of the first force sensor S1 and the second force sensor S2 in the control unit 10. FIG. 13 shows changes in various parameters in a series of movements in which the wearer of the finger joint driving device 1B grips a gripping target with the hand 100 and then opens the hand 100 to separate the gripping target as in FIG. 6. The outputs (detected values) of the first force sensor S1 and the second force sensor S2, an absolute value $|s2-(s1-BL)|$ of a difference between the outputs of the force sensors, and a movement velocity (rotation velocity) of the first link portion 3 are shown as the parameters.

As illustrated in FIG. 13, first, the movement state of the finger joint driving device 1B becomes the free stop state U6 in a stop state in which the hand 100 is free hand. In this case, since a pressure at the time of the wearing is not applied to the second force sensor S2, the output thereof is "0." On the other hand, a pressure at the time of wearing is applied to the first force sensor S1 and, for example, an offset of a base value BL occurs as an output value (detected value). Accordingly, in the disposition structure of the second force sensor S2 according to the embodiment, no force is applied to the second force sensor S2 in the free hand state and, therefore, an output of the second force sensor S2 remains at "0." On the other hand, even in the free hand state, the output of the first force sensor S1 is changed using the base value BL as a criterion in response to a motion of the wearer moving the hand 100. For example, since a movement of gripping the hand 100 is performed in a direction in which no force is applied to the first force sensor S1, the output of the first force sensor S1 is decreased to be less than the base value BL. Conversely, since a movement of opening the hand 100 is performed in a direction a force is applied, the output of the first force sensor S1 is increased to be greater than the base value BL. In the grip state, a positive force is applied to the second force sensor S2 due to pressing to the gripping target and a force is also applied to the first force sensor S1 via the middle joint part 103. Accordingly, as will be described below, based on the output of the second force sensor S2, an output (hereinafter also referred to as an "output (s1−BL) of the first force sensor S1") of the first force sensor S1 after the base value BL serving as the offset is subtracted from the output of the first force sensor S1, and an absolute value (output difference |s2−(s1−BL)|) of the difference between these outputs, the movement state in which the wearer moves the hand 100 can be determined and the movement state of the finger joint driving device 1 can be controlled.

When the wearer starts a movement in a bending direction of the index finger 101 in order to grip the gripping target at time t1, the outputs of the first force sensor S1 and the second force sensor S2 are changed. Specifically, the output (s1−BL) of the first force sensor S1 becomes less than the output ("0") of the second force sensor S2. Then, the movement state of the finger joint driving device 1B becomes the free grasp movement state U2 from a time point at which an output difference |s2−(s1−BL)| is equal to or greater than the movement determination threshold value Ta at time t2. At this time, the actuator 6A rotates the first link portion 3 at a movement velocity according to the output difference |s2−(s1−BL)| so that the index finger 101 is bent and the gripping of the hand 100 is assisted.

Then, at time t3, when the index finger 101 comes into contact with the gripping target, a positive force according to the extent that the index finger 101 grips the gripping target is applied to the second force sensor S2 and a positive force is also applied to the first force sensor S1 from the dorsal side of the middle joint part 103, and thus the movement state of the finger joint driving device 1B becomes the grip progress state U1 from the free grasp movement state U2. In this case, the movement velocity of the first link portion 3 by the actuator 6A decreases to be in the state in which the movement velocity decreases toward "0." However, a driving force (torque) according to the output difference |s2−(s1−BL)| is applied from the actuator 6A to the first link portion 3 as an assist force to assist the gripping of the gripping target. Thus, the outputs of the first force sensor S1 and the second force sensor S2 increase while the output of the second force sensor S2 remains to be greater than the output (s1−BL) of the first force sensor S1, and the assist force increases to assist the grip force by which the gripping target is tightly gripped with the hand 100 (see FIG. 6).

Then, at a time point at which the output difference |s2−(s1−BL)| is less than the movement determination threshold value Ta at time t5, the movement state of the finger joint driving device 1B becomes the grip force maintenance state U5. In this state, the output (s1−BL) of the first force sensor S1 is substantially the same as the output of the second force sensor S2, a constant assist force is applied by the finger joint driving device 1B, the gripping target is gripped by a constant grip force with the hand 100.

In the final of the grip force maintenance state U5, when the wearer starts a movement of opening the hand 100, the output (s1−BL) of the first force sensor S1 is less than the output of the second force sensor S2 and decreases. When the output difference |s2−(s1−BL)| is equal to or greater than the movement determination threshold value Ta at time t6, the movement state of the finger joint driving device 1B becomes the grip release movement state U3 from the grip force maintenance state U5. Then, the outputs of the first force sensor S1 and the second force sensor S2 decrease in response to an increase in the opening of the hand 100 and the gripping target is released at a time point at which the output of the second force sensor S2 becomes "0." Here, when the output difference |s2−(s1−BL)| is equal to or greater than the movement determination threshold value Ta, as illustrated in FIG. 13, the movement state of the finger joint driving device 1B becomes the free release movement state U4. In the free release movement state U4 a positive force greater than the base value BL is applied to the first force sensor S1 and the output of the second force sensor S2 becomes "0." At this time, the actuator 6A rotates the first link portion 3 at a movement velocity according to the output difference |s2−(s1−BL)|, so that the rotation of the proximal interphalangeal joint 107 is assisted, the spreading of the index finger 101 is assisted, and the opening of the hand 100 is assisted.

Then, immediately before the movement in which the wearer opens the hand 100 stops, the output of the first force sensor S1 also decreases and the output difference |s2−(s1−BL)| is less than the movement determination threshold value Ta. At this time, the movement state of the finger joint driving device 1B returns to the "free stop state U6." The movement of the finger joint driving device 1B illustrated in FIG. 13 is performed in such a manner that the control unit 10 performs a control process to be described below according to the outputs of the first force sensor S1 and the second force sensor S2.

Figure 14:
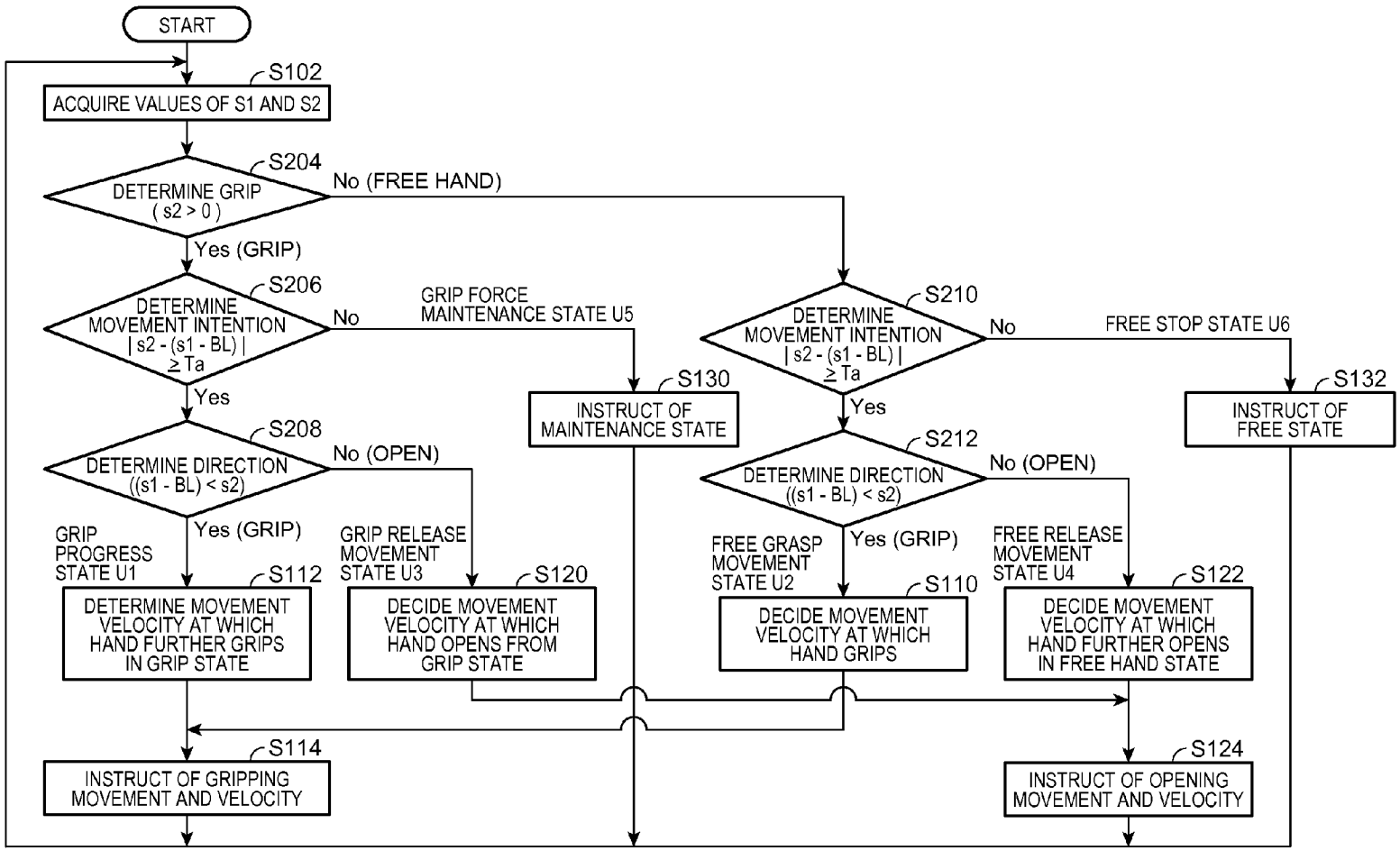
FIG. 14 is a flowchart illustrating a control process performed by the control unit according to outputs of the first and second force sensors.

FIG. 14 is a flowchart illustrating a control process performed by the control unit 10 according to the outputs of the first force sensor S1 and the second force sensor S2. The control flow is repeatedly performed until the power of the finger joint driving device 1B is turned off and the movement is stopped after the power is activated. In the control flow, steps S104 to S108, S118, and S128 of the control flow illustrated in FIG. 7 are substituted with steps S204 to S212 and the processes of steps S102, S110 to S114, S120 to S124, S130, and S132 are the same.

After the values of the outputs of the first force sensor S1 and the second force sensor S2 are acquired in step S102, whether the movement state is the grip state is determined in step S204. Specifically, it is determined whether the acquired output value of the second force sensor S2 is greater than "0." Further, "0" corresponds to the grip determination threshold value Tb. For example, before time t3 of FIG. 13, it is determined that the movement state is not the grip state since the output of the second force sensor S2 is "0." From time t3 to time t7, it is determined that the movement state is the grip state since the outputs of the second force sensor S2 is greater than "0."

When it is determined that the movement state is the grip state, it is determined in step S206 whether the wearer has a movement intention. Specifically, it is determined whether the output difference |s2−(s1−BL)] is equal to or greater than the movement determination threshold value Ta. For example, it is determined that the wearer has the movement intention at time t2 to time t5 and at time t6 to time t8 of FIG. 13. At time t5 to time t6, it is determined that the wearer has no movement intention.

When it is determined that the movement state is not the grip state (non-grip state (free hand state)), it is determined in step S210 whether the wearer has a movement intention, as in step S206. In step S210, the movement state is not the grip state and the output of the second force sensor S2 is "0." Therefore, whether the wearer has the movement intention is determined depending on whether the output difference |s1−BL| between the base value BL and the first force sensor S1 is equal to or greater than the movement determination threshold value Ta. For example, at time t2 to time t3 and time t8 to time t9 of FIG. 13, it is determined that the wearer has the movement intention. Before time t1 and after time t9, it is determined that the wearer has no movement intention.

When it is determined in step S206 that the wearer has the movement intention at the grip state, the output of the second force sensor S2 is compared to the output (s1−BL) of the first force sensor S1 and a movement direction intended by the wearer is determined in step S208. When the output of the second force sensor S2 is greater than the output (s1−BL) of the first force sensor S1, the movement direction is determined to be a hand gripping direction (finger bending direction), the movement state of the finger joint driving device 1B is the grip progress state U1 (see FIG. 13), and the movement velocity at which the hand further grips in the grip state is decided according to the output difference |s2−(s1−SL)| in step S112. Then, in step S114, the actuator 6A is instructed of the movement in which the hand grips at the decided movement velocity and the actuator 6A rotates the first link portion 3 at the instructed movement velocity. Conversely, when the output of the second force sensor S2 is equal to or less than the output (s1−BL) of the first force sensor S1, it is determined that the movement direction is the hand opening direction (finger spreading direction), the movement state of the finger joint driving device 1B is the grip release movement state U3 (see FIG. 13), and the movement velocity at which the hand opens from the grip state is decided according to the output difference |s2−(s1−BL)| in step S120. Then, as in step S114, in step S124, the actuator 6A is instructed of a movement in which the hand opens at the decided movement velocity and the actuator 6A rotates the first link portion 3 at the instructed movement velocity.

Conversely, when it is determined in step S206 that the wearer has no movement intention in the grip state, the movement state of the finger joint driving device 1B is the grip force maintenance state U5 (see FIG. 13), the actuator 6A is instructed to maintain the movement with the driving force generated at that time point in step S130, and the actuator 6A maintains the driving state of the first link portion 3.

When it is determined in step S210 that the wearer has the movement intention at the non-grip state (free hand state), the movement direction intended by the wearer is determined in step S212, as in step S208. When the output of the second force sensor S2 is greater than the output (s1−BL) of the first force sensor S1, it is determined that the movement direction is the direction in which the hand grips, the movement state of the finger joint driving device 1B is the free grasp movement state U2 (see FIG. 13), and the movement velocity at which the hand grips is decided according to the output difference |s2−(s1−BL)| in step S110. Then, in step S114, the actuator 6A is instructed of a movement in which the hand grips at the decided movement velocity and the actuator 6A rotates the first link portion 3 at the instructed movement velocity. Conversely, when the output of the second force sensor S2 is equal to or less than the output (s1−BL) of the first force sensor S1, it is determined that the movement direction is the direction in which the hand opens, the movement state of the finger joint driving device 1B is the free release movement state U4 (see FIG. 13), and the movement velocity at which the hand opens from the free hand state is decided according to the output difference |s2−(s1−BL)| in step S122. Then, as in step S114, in step S124, the actuator 6A is instructed of a movement in which the hand opens at the decided movement velocity and the actuator 6A rotates the first link portion 3.

Conversely, when it is determined in step S210 that the wearer has no movement intention in the non-grip state (free hand state), the movement state of the finger joint driving device 1B is the free stop state U6 (see FIG. 13), and the actuator 6A is instructed of a free stop state and the actuator 6A stops the driving of the first link portion 3 in step S132.

In the above-described embodiment, the movement intention of the wearer is detected based on the outputs of the two force sensors, that is, the first force sensor S1 and the second force sensor S2, and the finger joint driving device 1B is operated according to the movement intention, so that the hand 100 wearing the finger joint driving device 1B, more specifically, the movement of the index finger 101, can be assisted, for example, as in FIG. 13.

Figure 15:
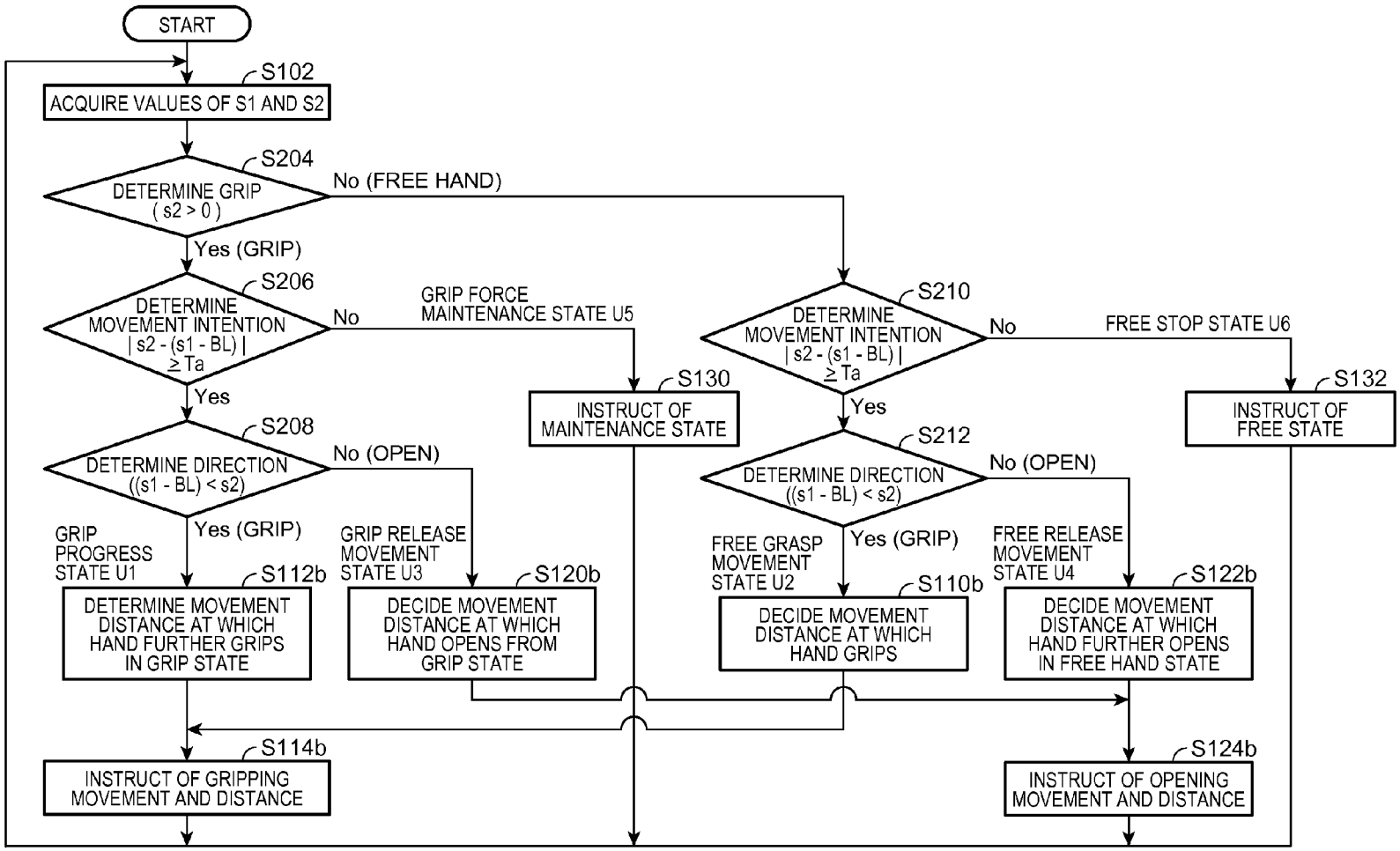
FIG. 15 is a diagram for describing a modification example of a control flow of FIG. 14.

FIG. 15 is a diagram for describing a modification example of the control flow of FIG. 14. In the control flow, steps S110, S112, S114, S120, S122, S124, S130, and S132 of the control flow of FIG. 14 are substituted with steps S110*b*, S112*b*, S114*b*, S120*b*, S122*b*, S124*b*, S130*b*, and S132*b* as in the control flow of FIG. 9, the movement distance according to each of the determined movement states is decided, and the actuator 6A is operated according to the decided movement distance. The parameter used to decide the driving amount of the first link portion 3 by the actuator 6A is the movement distance rather than the movement velocity. By detecting a movement intention of the wearer based on the outputs of the two force sensors, that is, the first force sensor S1 and the second force sensor S2, and operating the finger joint driving device 1B according to the movement intention, it is possible to assist the movement of the hand 100 wearing the finger joint driving device 1B, more specifically, the movement of the index finger 101, for example, as illustrated in FIG. 13.

By confirming the value (detected value) of the output of the third force sensor S3 using the gripping target provided with the third force sensor S3 even in the grip force maintenance state U5 according to the embodiment, as in the first embodiment, it is possible to confirm that the grip force by the finger joint driving device 1B is maintained to have a constant magnitude (see FIGS. 12 and 13).

When the output (s1−BL) of the first force sensor S1 is assumed to be the first force sensor S1, the control flow illustrated in FIG. 7 or 9 can be applied in the embodiment.

C. Third Embodiment

Figure 16:
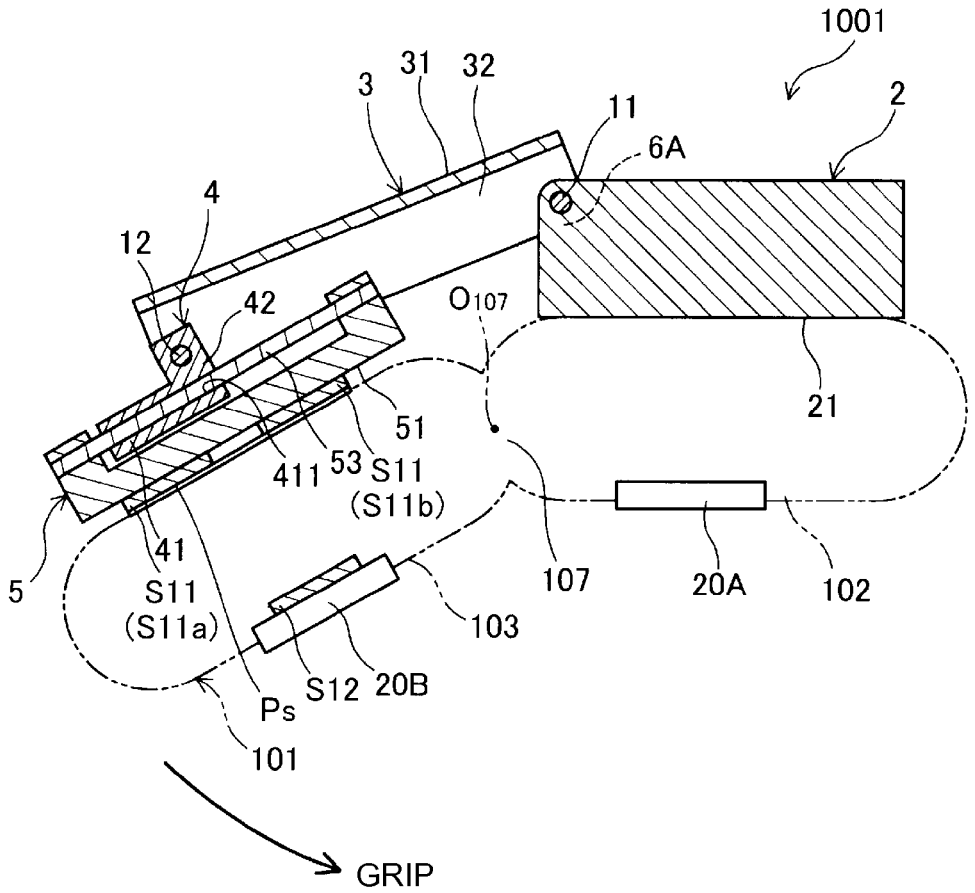
FIG. 16 is a sectional view illustrating a finger joint driving device according to a third embodiment.
Figure 17:
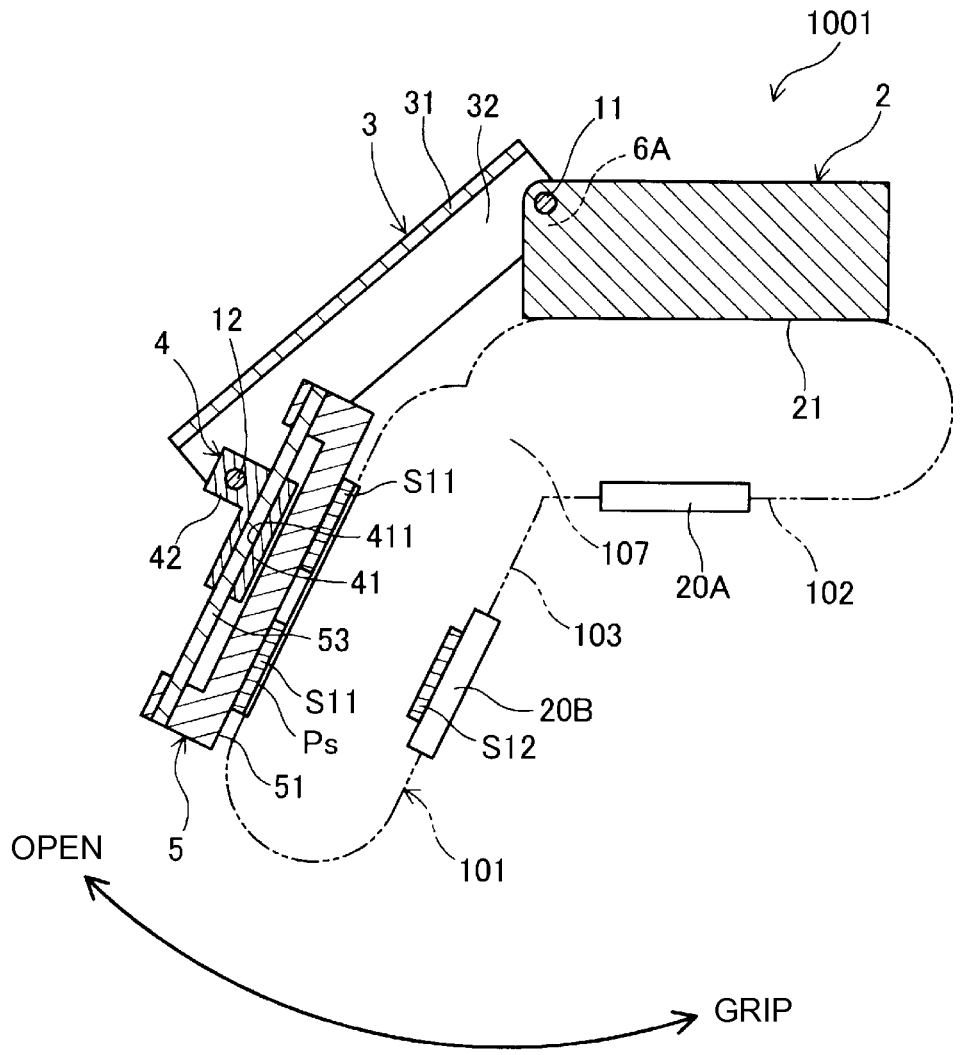
FIG. 17 is a sectional view illustrating a state in which a finger is bent from the state illustrated in FIG. 16.

FIG. 16 is a sectional view illustrating a finger joint driving device according to a third embodiment. FIG. 16 corresponds to the sectional view of the finger joint driving device 1 taken along the line A-A in the first embodiment illustrated in FIG. 2. FIG. 17 is a sectional view illustrating a state in which a finger is bent from the state illustrated in FIG. 16.

A finger joint driving device 1001 according to the embodiment is different from the finger joint driving device 1 according to the first embodiment in that the first force sensor S1 is substituted with a plurality of first force sensors S11 and the second force sensor S2 is substituted with a second force sensor S12, and a pressure reception plate Ps entirely extending across the plurality of first force sensors S11 are further provided. The finger joint driving device 1001 according to the embodiment is also different from the finger joint driving device 1 according to the first embodiment in the control operation performed by the control unit 10 according to the disposition of the plurality of first force sensors S11. The finger joint driving device 1001 according to the embodiment is the same as the finger joint driving device 1 in the other points. Accordingly, the differences from the finger joint driving device 1 according to the first embodiment will be described below.

In the finger joint driving device 1001, as illustrated in FIGS. 16 and 17, the plurality of first force sensors S11 (in the example of the drawing, two first force sensors S11*a* and S11*b*) are formed in the longitudinal direction of the index finger 101 on the surface 51 of the second base portion 5 on the dorsal side of the middle joint part 103. The pressure reception plate Ps entirely extending across the plurality of first force sensors S11 is provided on the plurality of first force sensors S11. One second force sensor S12 is disposed on the surface of the second wearing band 20B on the ventral side of the middle joint part 103.

That is, the first force sensors S11 and the second force sensor S12 face each other with the middle joint part 103 therebetween. The first force sensors S11 and the second force sensor S12 are preferably disposed to face each other in a direction in which the index finger 101 rotates. As will be described below, the reason why this disposition is preferable is that when the person intends to bend and spread the index finger 101, it is easy to estimate the bending and spreading intention based on detected values detected by the first force sensors S11 and the second force sensor S12. However, the invention is not limited to this disposition. The first force sensors S11 may be disposed on the dorsal side of the finger and the second force sensor S12 may be disposed on the ventral side of the finger with the index finger 101 (the middle joint part 103) therebetween.

The plurality of first force sensors S11 is a force sensor that detects a force applied from the side of the surface 51 of the second base portion 5 to the dorsal side of the middle joint part 103 and a force applied from the dorsal side of the middle joint part 103 to the side of the surface 51 of the second base portion 5 when the rotation of the proximal interphalangeal joint 107 is assisted by the actuator 6A to be described below. The one second force sensor S12 is a force sensor that detects a force applied from the ventral side of the middle joint part 103 to the side of the second wearing band 20B and a force applied from a gripping target (not illustrated) to the ventral side of the middle joint part 103 via the second wearing band 20B when the index finger 101 is allowed to grip the gripping target. The pressure reception plate Ps is provided to suppress distribution of the force applied from the surface 51 of the second base portion 5 to the dorsal side of the middle joint part 103 and the force applied from the dorsal side of the middle joint part 103 to the side of the surface 51 of the second base portion 5 and to efficiently these forces to the two first force sensors S11. However, the pressure reception plate Ps can be omitted. The force applied from the side of the surface 51 of the second base portion 5 to the dorsal side of the middle joint part 103 and the force applied from the dorsal side of the middle joint part 103 to the side of the surface 51 of the second base portion 5 are referred to as "forces generated between the second base portion 5 and the middle joint part 103 of the index finger 101."

The detected values detected by the plurality of first force sensors S11 and the one second force sensor S12 are used for the control unit 10 to control the operation of the actuator 6A. The control unit 10 controls a movement state of the actuator 6A based on the detected values detected by the two first force sensors S11 and the one second force sensor S12, specifically, a rotation state of the first link portion 3, to bend and spread the proximal interphalangeal joint (second joint) 107.

The first base portion (first member) 2, the first link portion (second member) 3, the second link portion (third member) 4, the second base portion (fourth member) 5, the first wearing band 20A, and the second wearing band 20B correspond to a "wearable mechanism" according to the invention. The second base portion 5 corresponds to an "assistant portion" according to the invention, the second wearing band 20B corresponds to an "interposing portion," and the second base portion 5 and the second wearing band 20B corresponds to "assistant units."

Figure 18:
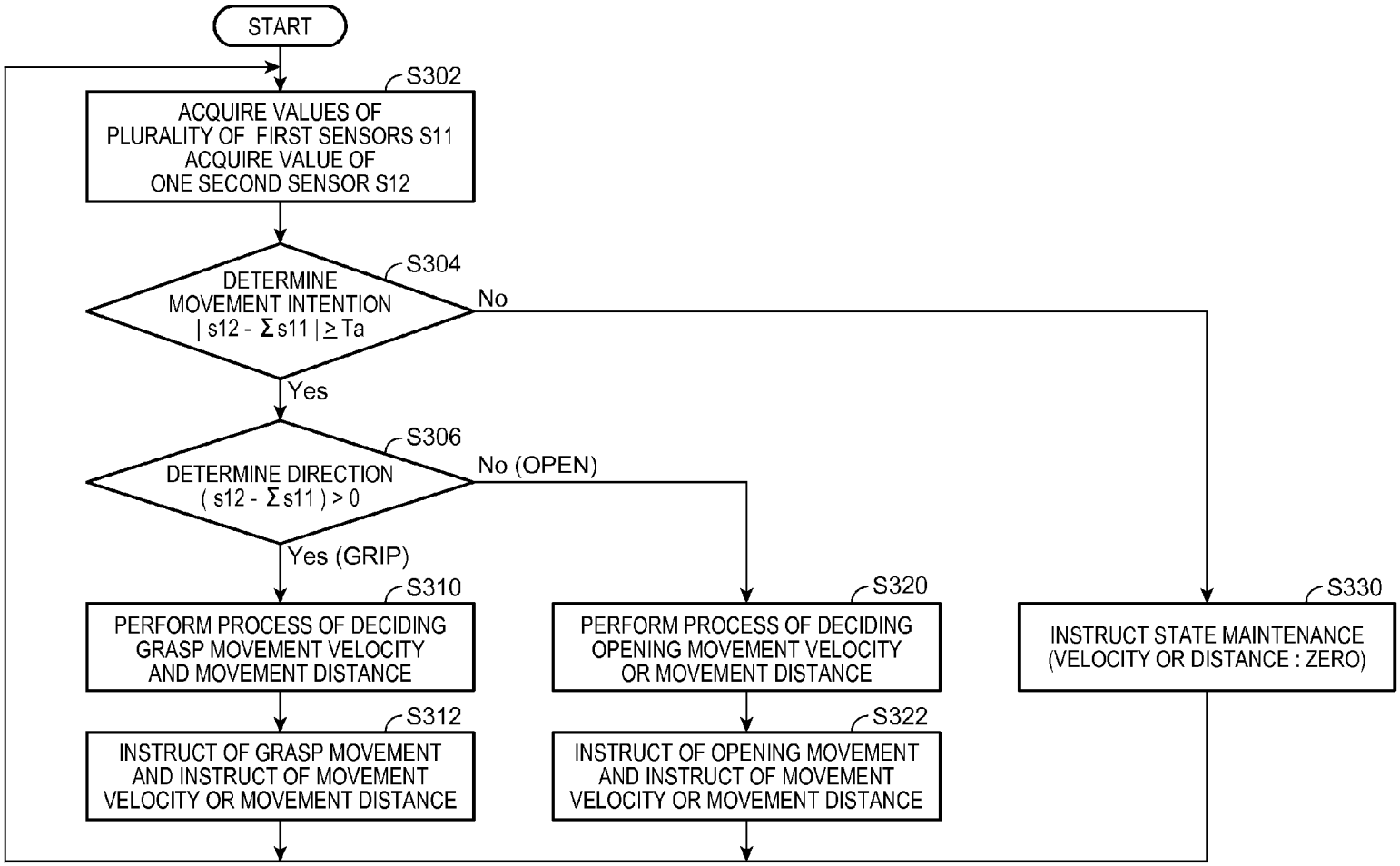
FIG. 18 is a flowchart illustrating a control process performed by the control unit according to outputs of a plurality of first force sensors and one second force sensor.

FIG. 18 is a flowchart illustrating the control process performed by the control unit 10 according to outputs of the plurality of first force sensors S11 and the one second force sensor S12. The control flow is repeatedly performed until the power of the finger joint driving device 1001 is turned off after the power is activated.

First, in step S302, the values of the outputs of the plurality of first force sensors S11 and the one second force sensor S12 are acquired. In step S304, whether the wearer has a movement intention is determined. Specifically, whether the wearer has the movement intention is determined depending on whether the absolute value $|s12-\Sigma s11|$ which is the output difference between a sum of the outputs (s11) of the plurality of first force sensors S11 and the output (s12) of the second force sensor S12 is equal to or greater than the movement determination threshold value Ta. The value of the movement determination threshold value Ta is confirmed and set in advance experimentally in consideration of, for example, prevention of an erroneous movement or determination possibility of a movement intention of the wearer. As will be described below, when it is determined that the wearer has the movement intention, the processes of steps S306 to S322 are performed. When it is determined that the wearer has no movement intention, the process of step S330 is performed. A pressure from the wearing band at the time of the wearing actually is related to the first force sensors S11 and the second force sensor S12. However, it is here assumed that the pressure is calibrated and the output is "0."

When it is determined in step S304 that the wearer has the movement intention, a movement direction intended by the wearer is determined in step S306. Specifically, the movement direction intended by the wearer is determined depending on whether a difference ($s12-\Sigma s11$) between the output of the second force sensor S12 and the sum of the outputs of the plurality of first force sensors S11 is greater than "0," that is, the output of the second force sensor S12 is greater than the sum ($\Sigma s11$) of the outputs of the plurality of first force sensors. As will be described, when the output difference (s12−Σs11) is greater than "0," the movement direction is determined to be a hand gripping direction (finger bending direction) and the processes of steps S310 to S312 are performed. When the output difference (s12−Σs11) is equal to or less than "0," the movement direction is determined to be a hand opening direction (finger spreading direction) and the processes of steps S320 to S322 are performed.

When the movement direction is determined to be the hand gripping direction, a movement velocity (grasp movement velocity) or a movement distance (grasp movement distance) at which the hand grips is decided according to the output difference |s12−Σs11| in step S310. Then, in step S312, the actuator 6A is instructed of the hand gripping movement (grasp movement) of the decided movement velocity or movement distance and the actuator 6A rotates the first link portion 3 based on the instructed movement velocity or movement distance.

Conversely, when it is determined that the movement direction is the hand opening direction, the movement velocity (release movement velocity) or the movement distance at which the hand opens is decided according to the output difference |s11−Σs12| in step S320. As in step S312, in step S322, the actuator 6A is instructed of the hand opening movement (release movement) of the decided movement velocity or movement distance and the actuator 6A rotates the first link portion 3 based on the instructed movement velocity or movement distance.

When it is determined in step S304 that the wearer has no movement intention, the actuator 6A is instructed to maintain the immediately previous state (state maintenance) in which the movement velocity or movement distance is "0" and the actuator 6A operates to maintain the instructed state in step S330. For example, in the case of the state in which the hand 100 grips an object, the actuator 6A operates to maintain the driving state of the first link portion 3 at that time point. In the case of the free state in which the hand 100 grips nothing, the actuator 6A stops the movement in the state in which the position of the first link portion 3 is maintained at that time point.

As described above, in the finger joint driving device 1001 according to the embodiment, the values of the outputs of the plurality of first force sensors S11 and the value of the output of the one second force sensor are acquired, and the movement state of the finger can be detected with high accuracy through the movement intention determination (presence or absence of the intention to move the hand) and the movement direction determination (hand gripping [grasping]/opening [releasing]) based on the acquired output values. According to this result, the actuator 6A can be allowed to drive the first link portion 3. Thus, it is possible to assist the movement of the hand 100 wearing the finger joint driving device 1001, more specifically, the movement of the index finger 101. In particular, in the finger joint driving device 1001 according to the embodiment, the plurality of first force sensors S11 are disposed on the surface 51 of the second base portion 5 on the dorsal side of the middle joint part 103 in the longitudinal direction of the index finger 101 (see FIG. 16). As will be described below, a force generated between the second base portion 5 and the middle joint part 103 of the index finger 101 can be detected with high accuracy, the determination of the movement intention of the wearer and the determination of the movement direction can be performed with high accuracy, and thus the movement state of the finger can be detected with high accuracy.

Figure 19A:
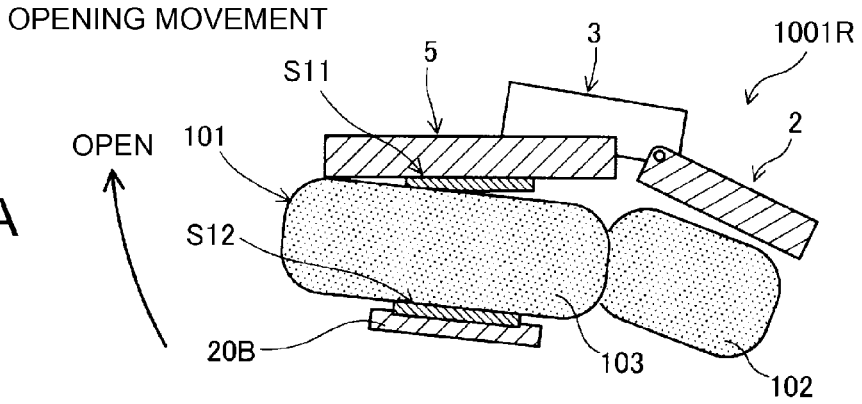
FIGS. 19A to 19C are diagrams for describing an advantage obtained by disposing the plurality of first force sensors.
Figure 19B:
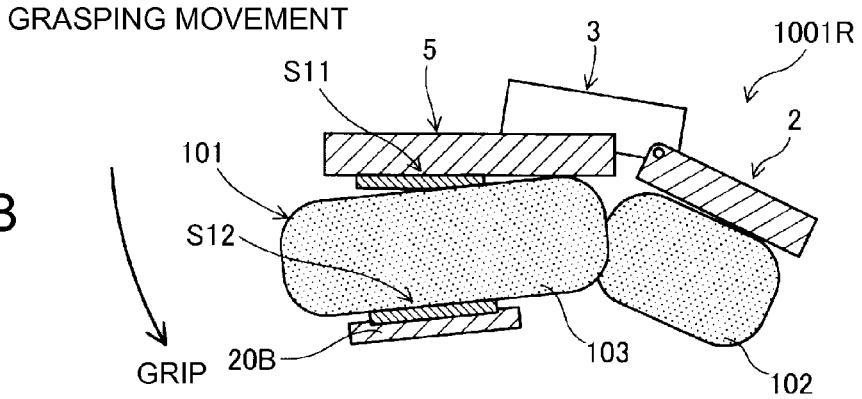
Figure 19C:
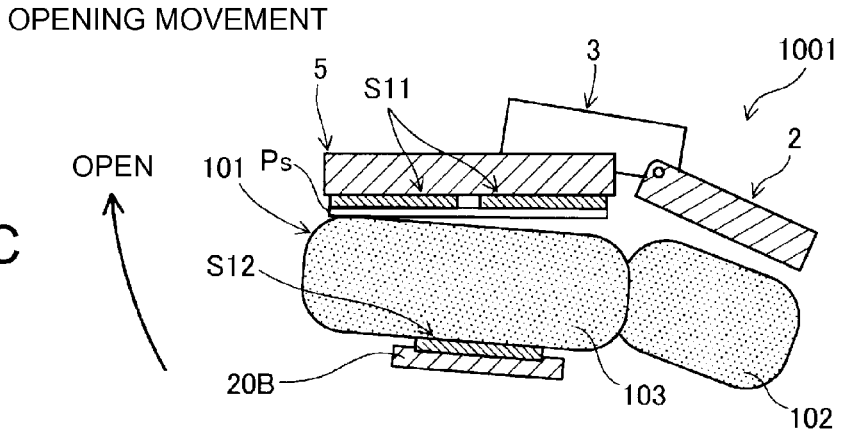

FIGS. 19A to 19C are diagrams for describing an advantage obtained by disposing the plurality of first force sensors S11. FIGS. 19A and 19B schematically illustrate a finger joint driving device 1001R when one first force sensor S11 is moved in the hand opening direction (finger spreading direction) and is moved in the hand gripping direction (finger bending direction) in a state in which the first force sensor S11 is disposed according to a comparative example. FIG. 19C schematically illustrates the finger joint driving device 1001 when the first force sensors S11 are moved in the hand opening direction (the finger spreading direction) in FIG. 19A according to the embodiment.

In the case of the comparative example in which the one first force sensor S11 is disposed to face the second force sensor S12 with the middle joint part 103 of the index finger 101 therebetween, as illustrated in FIGS. 19A and 19B, a deviation may occur in a portion in which the second base portion 5 comes into contact with the dorsal side of the index finger 101 (particularly, the middle joint part 103) when the wearer bends and spreads his or her index finger. When the index finger 101 (particularly, the middle joint part 103) comes into contact with a portion excluding the first force sensor S11, for example, the second base portion 5, a load applied to the first force sensor S11 diffuses and thus decreases further than when the index finger 101 comes into contact with only the first force sensor S11. Therefore, it is difficult to accurately detect a force (a force operated when the finger intends to be spread) operated when the wearer intends to open his or her hand. Accordingly, it is difficult for the one first force sensor S11 to detect a force generated between the second base portion 5 and the middle joint part 103 of the index finger 101 according to the movement intention of the wearer with high accuracy. The force sensor (contact force sensor) used for the first force sensor S11 detects a force applied in one axis direction (a direction perpendicular to the surface of the sensor). Therefore, when a deviation occurs, as illustrated in FIGS. 19A and 19B, a moment component associated with the flexing and stretching of the finger may be added to the value of the detected output, and thus it is difficult to detect the force with high accuracy.

In contrast, in the embodiment, as illustrated in FIG. 19C, the plurality of first force sensors S11 are disposed in the longitudinal direction of the index finger 101, and thus a distribution of a different force can be detected at each of the position at which plurality of first force sensors S11 are disposed. Thus, it is possible to detect the force (the force operated when the wearer intend to spread the finger) operated when the wearer opens his or her hand with high accuracy. The force (the force by which the wearer bends his or her finger) operated when the wearer intends to grip his or her hand can also be detected by the second force sensor S12. As a result, for example, as described in the control flow of FIG. 18, by using the sum (Σs11) of the outputs of the plurality of first force sensors S11 and the output of the one second force sensor S12 to determine the movement intention or determine the movement direction, it is possible to determine the movement intention or determine the movement direction with high accuracy.

In the foregoing embodiment, the case in which the two first force sensors S11 are disposed in the longitudinal direction of the index finger 101 has been exemplified, but the invention is not limited thereto. Three or more first force sensors S11 may be disposed in the longitudinal direction of the index finger 101. The plurality of first force sensors S11 may be disposed in the transverse direction as well as the longitudinal direction. When the plurality of sensors are disposed, a distribution of the generated force can be detected more accurately. Thus, the force (the force by the wearer intends to spread his or her finger) operated when the wearer intends to open his or her hand can be detected with higher accuracy, the determination of the movement intention or the determination of the movement direction can be performed with higher accuracy, and the movement state of the finger can be detected with high accuracy.

D. Fourth Embodiment

Figure 20:
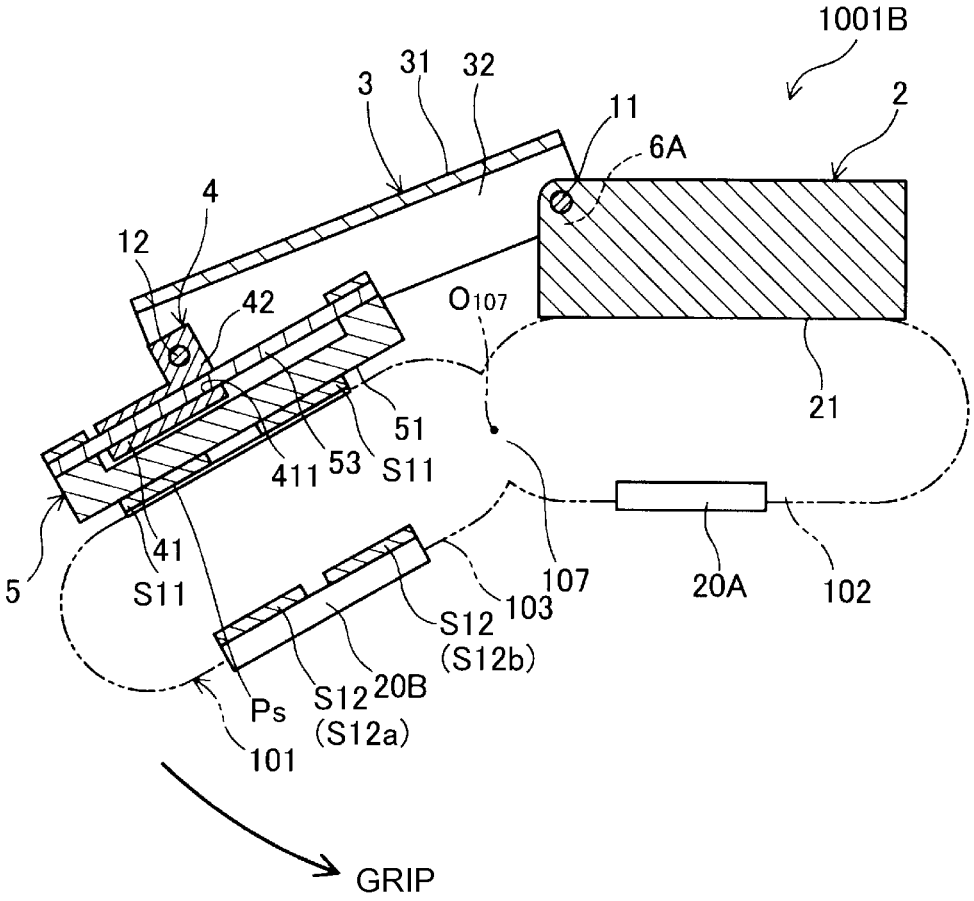
FIG. 20 is a sectional view illustrating a finger joint driving device according to a fourth embodiment.

FIG. 20 is a sectional view illustrating a finger joint driving device 1001B according to a fourth embodiment. FIG. 20 corresponds to the sectional view of the finger joint driving device 1001 taken along the line A-A in the third embodiment illustrated in FIG. 16. The finger joint driving device 1001B according to the embodiment is different from the finger joint driving device 1001 (see FIG. 16) according to the third embodiment in that a plurality of second force sensors S12 (two force sensors S12*a* and S12*b* in the example of FIG. 20) are disposed in the second wearing band 20B in the longitudinal direction of the index finger 101, as illustrated in FIG. 20. As will be described below, a process for determination of a movement intention and determination of a movement direction in the control process performed by the control unit 10 is different in addition to the difference in the structure.

Figure 21:
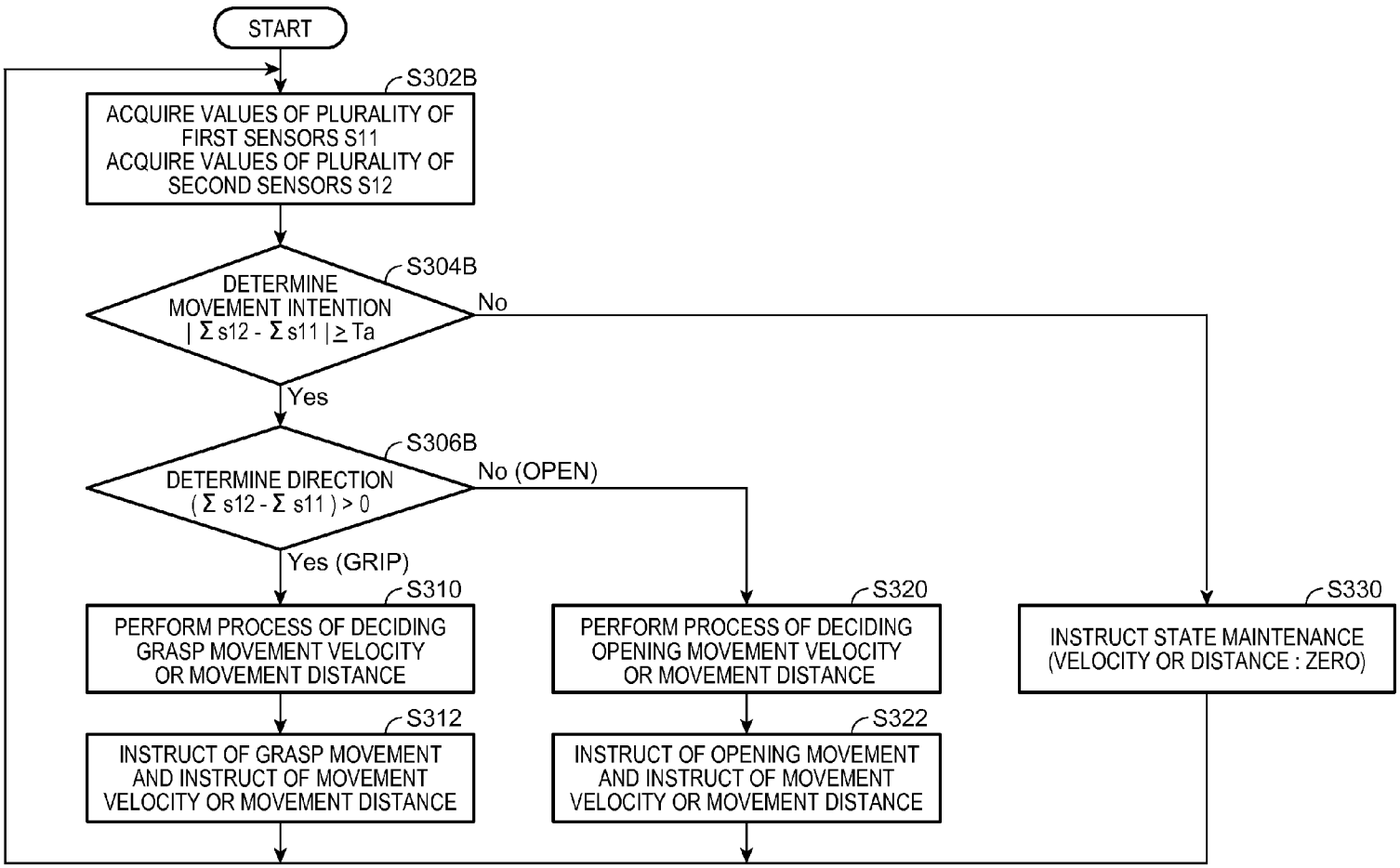
FIG. 21 is a flowchart illustrating a control process performed by the control unit according to outputs of a plurality of first force sensors and a plurality of second force sensors.

FIG. 21 is a flowchart illustrating a control process performed by the control unit 10 according to the outputs of the plurality of first force sensors S11 and the plurality of second force sensors S12. The control flow is repeatedly performed until the power of the finger joint driving device 1001B is turned off after the power is activated. In the control flow, steps S302 to S306 of the control flow illustrated in FIG. 18 according to the third embodiment are substituted with steps S302B to S306B and the processes of other steps S310 to S330 are the same.

In step S302B, the values of the outputs of the plurality of first force sensors S11 and the plurality of second force sensors S12 are acquired. In step S304B, whether the wearer has a movement intention is determined. Specifically, whether the wearer has the movement intention is determined depending on whether the absolute value $|\Sigma s12-\Sigma s11|$ which is a difference between a sum of the outputs of the plurality of first force sensors S11 and a sum of the outputs of the second force sensors S12 is equal to or greater than the movement determination threshold value Ta.

When it is determined that the wearer has no movement intention, the actuator 6A is instructed to maintain the immediately previous state (state maintenance) in which the movement velocity or movement distance is "0" and the actuator 6A operates to maintain the instructed state in step S330.

Conversely, when it is determined that the wearer has the movement intention, the movement direction intended by the wearer is subsequently determined in step S306B. Specifically, the movement direction intended by the wearer is determined depending on whether a difference ($\Sigma s12-\Sigma s11$) between a sum ($\Sigma s12$) of the outputs of the plurality of second force sensors 12 and a sum of the outputs of the plurality of first force sensors S11 is greater than "0," that is, the sum ($\Sigma s12$) of the outputs of the plurality of second force sensors S12 is greater than the sum ($\Sigma s11$) of the outputs of the plurality of first force sensors.

When the output difference ($\Sigma s12-\Sigma s11$) is greater than "0," it is determined that the movement direction is the hand gripping direction (the finger bending direction). In step S310, the movement velocity (grasp movement velocity) or the movement distance (grasp movement distance) at which the hand grips is decided according to the output difference $|\Sigma s12-\Sigma s11|$.

Then, in step S312, the actuator 6A is instructed of a hand gripping movement (grasp movement) at the decided movement velocity or movement distance and the actuator 6A is allowed to rotate the first link portion 3 based on the instructed movement velocity or movement distance.

Conversely, when the output difference ($\Sigma s12-\Sigma s11$) is equal to or less than "0," it is determined that the movement direction is the hand opening direction (the finger spreading direction). In step S320, the movement velocity (release movement velocity) or the movement distance (grasp movement distance) at which the hand opens is decided according to the output difference $|\Sigma s11-\Sigma s12|$. As in step S312, in step S322, the actuator 6A is instructed of the hand opening movement (release movement) of the decided movement velocity or movement distance and the actuator 6A rotates the first link portion based on the instructed movement velocity or movement distance.

Even in the finger joint driving device 1001B according to the embodiment, the values of the outputs of the plurality of first force sensors S11 and the values of the outputs of the plurality of second force sensors are acquired, and the actuator 6A can be allowed to drive the first link portion 3 according to the results of the movement intention determination (presence or absence of the intention to move the hand) and the movement direction determination (hand gripping [grasping]/opening [releasing]) based on the acquired output values. Thus, it is possible to assist the movement of the hand 100 wearing the finger joint driving device 1001B, more specifically, the movement of the index finger 101. In particular, in the finger joint driving device 1001B according to the embodiment, the plurality of first force sensors S11 are disposed on the surface 51 of the second base portion 5 on the dorsal side of the middle joint part 103 in the longitudinal direction of the index finger 101 and the plurality of second force sensors S12 are disposed on the surface of the second wearing band 20B on the ventral side of the middle joint part 103 in the longitudinal direction of the index finger 101 (see FIG. 20). Thus, as in the third embodiment, the force (the force operated when the wearer intends to spread his or her finger) operated when the wearer intends to open his or her hand can be detected with high accuracy. Further, the force (the force operated when the wearer intends to bend his or her finger) operated when the wearer intends to grip his or her hand can also be detected with high accuracy by the plurality of second force sensors S12. As a result, as described in the control flow of FIG. 21, for example, by using the sum ($\Sigma s11$) of the values of the outputs of the plurality of first force sensors S11 and the sum ($\Sigma s12$) of the outputs of the plurality of second force sensors S12 to determine the movement intention or determine the movement direction, it is possible to perform the determination of the movement intention or the determination of the movement direction and to detect the movement state of the finger with high accuracy.

Even in the embodiment, three or more first force sensors S11 may be disposed in the longitudinal direction of the index finger 101. The plurality of first force sensors S11 may be disposed in the transverse direction as well as the longitudinal direction. Likewise, three or more second force sensors S12 may be disposed in the longitudinal direction of the index finger 101. The plurality of second force sensors S12 may be disposed in the transverse direction as well as the longitudinal direction. When the plurality of sensors are disposed, a distribution of the generated force can be detected more accurately. Thus, the force (the force by the wearer intends to spread his or her finger) operated when the wearer intends to open his or her hand and the force (that force with which the finger is bent) operated when the hand grips can be detected with higher accuracy, the determination of the movement intention or the determination of the movement direction can be performed with higher accuracy, and the movement state of the finger can be detected with high accuracy.

E. Fifth Embodiment

Figure 22:
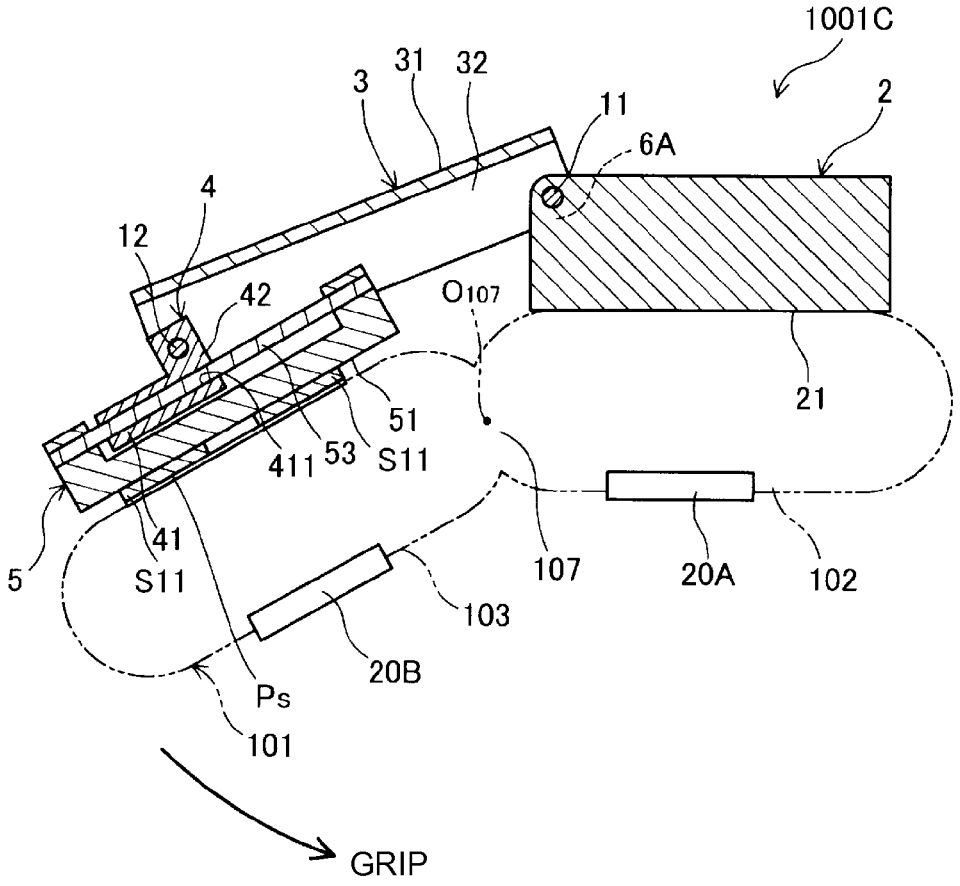
FIG. 22 is a sectional view illustrating a finger joint driving device according to a fifth embodiment.

FIG. 22 is a sectional view illustrating a finger joint driving device 1001C according to a fifth embodiment. FIG. 22 corresponds to the sectional view of the finger joint driving device 1001 taken along the line A-A in the third embodiment illustrated in FIG. 16. The finger joint driving device 1001C according to the embodiment is different from the finger joint driving device 1001 (see FIG. 16) according to the third embodiment in that the second force sensor S12 is omitted, as illustrated in FIG. 22. As will be described below, a process for determination of a movement intention and determination of a movement direction in the control process performed by the control unit 10 is different as well as the difference in the structure.

Figure 23:
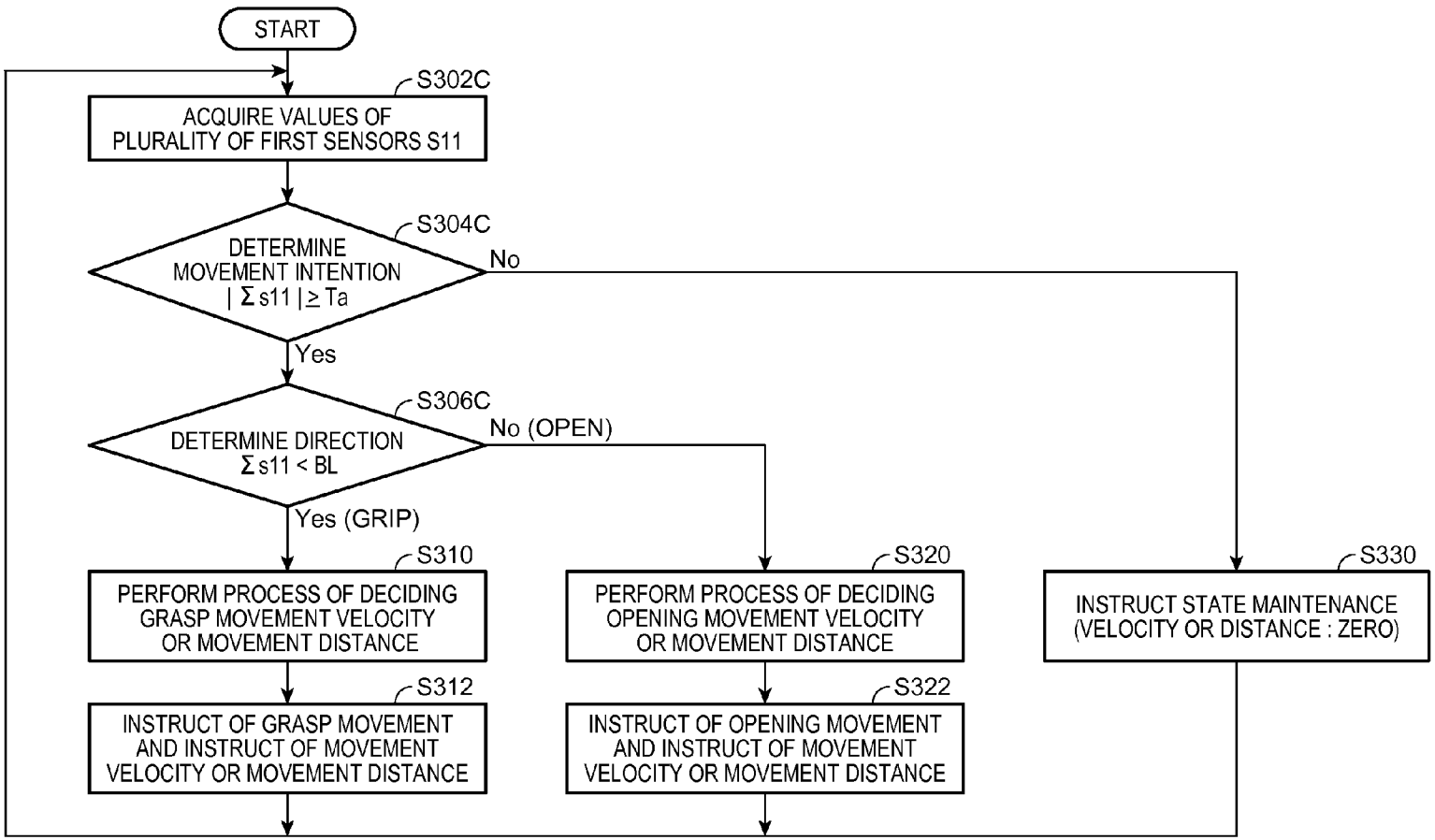
FIG. 23 is a flowchart illustrating a control process performed by the control unit according to outputs of a plurality of first force sensors.

FIG. 23 is a flowchart illustrating a control process performed by the control unit 10 according to outputs of the plurality of first force sensors S11. The control flow is repeatedly performed until the power of the finger joint driving device 1001C is turned off after the power is activated. In the control flow, steps S302 to S306 of the control flow illustrated in FIG. 18 according to the third embodiment are substituted with steps S302C to S306C and the processes of other steps S310 to S330 are the same.

In step S302C, the values of the outputs of the plurality of first force sensors S11 are acquired. In step S304C, whether the wearer has a movement intention is determined. Specifically, whether the wearer has the movement intention is determined depending on whether the absolute value |Σs11| which is a sum of the outputs of the plurality of first force sensors S11 is equal to or greater than the movement determination threshold value Ta.

When it is determined that the wearer has no movement intention, the actuator 6A is instructed to maintain the immediately previous state (state maintenance) in which the movement velocity or movement distance is "0" and the actuator 6A operates to maintain the instructed state in step S330.

Conversely, when it is determined that the wearer has the movement intention, the movement direction intended by the wearer is subsequently determined in step S306C. Specifically, the movement direction intended by the wearer is determined depending on whether the sum (Σs11) of the outputs of the plurality of first force sensors S11 is less than the base value BL. The base value BL indicates a pressure applied to all of the plurality of first force sensors S11 at the time of the wearing.

When the sum (Σs11) of the outputs of the plurality of first force sensors S11 is less than the base value BL, it is determined that the movement direction is the hand gripping direction (the finger bending direction). In step S310, the movement velocity (grasp movement velocity) or the movement distance (grasp movement distance) at which the hand grips is decided according to the sum |Σs11| of the outputs of the plurality of first force sensors S11. Then, in step S312, the actuator 6A is instructed of a hand gripping movement (grasp movement) at the decided movement velocity or movement distance and the actuator 6A is allowed to rotate the first link portion based on the instructed movement velocity or movement distance.

Conversely, when the sum (Σs11) of the outputs of the plurality of first force sensors S11 is equal to or greater than the base value BL, it is determined that the movement direction is the hand opening direction (the finger spreading direction). In step S320, the movement velocity (release movement velocity) or the movement distance (grasp movement distance) at which the hand opens is decided according to the sum |Σs11| of the outputs of the plurality of first force sensors S11. As in step S312, in step S322, the actuator 6A is instructed of the hand opening movement (release movement) of the decided movement velocity or movement distance and the actuator 6A rotates the first link portion 3 based on the instructed movement velocity or movement distance.

Even in the finger joint driving device 1001C according to the embodiment, the values of the outputs of the plurality of first force sensors S11 are acquired, and the actuator 6A can be allowed to drive the first link portion 3 according to the results of the movement intention determination (presence or absence of the intention to move the hand) and the movement direction determination (hand gripping [grasping]/opening [releasing]) based on the acquired output values. Thus, it is possible to assist the movement of the hand 100 wearing the finger joint driving device 1001C, more specifically, the movement of the index finger 101. In particular, in the finger joint driving device 1001C according to the embodiment, the plurality of first force sensors S11 are disposed on the surface 51 of the second base portion 5 on the dorsal side of the middle joint part 103 in the longitudinal direction of the index finger 101 (see FIG. 22). Thus, as in the third embodiment, the force (the force operated when the wearer intends to spread his or her finger) operated when the wearer intends to open his or her hand can be detected with high accuracy. Further, there is no disadvantage compared to the case in which the second force sensor is disposed, but the force (the force operated when the wearer intends to bend his or her finger) operated when the wearer intends to grip his or her hand can also be detected accurately to some extent. As a result, as described in the control flow of FIG. 18, for example, by using the sum (Σs11) of the values of the outputs of the plurality of first force sensors S11 to determine the movement intention or determine the movement direction, it is possible to perform the determination of the movement intention or the determination of the movement direction and to detect the movement state of the finger with high accuracy.

Even in the embodiment, three or more first force sensors S11 may be disposed in the longitudinal direction of the index finger 101. The plurality of first force sensors S11 may be disposed in the transverse direction as well as the longitudinal direction. When the plurality of sensors are disposed, a distribution of the generated force can be detected more accurately. Thus, the force (the force by the wearer intends to spread his or her finger) operated when the wearer intends to open his or her hand and the force (the force with which the finger is bent) operated when the hand grips can be detected with higher accuracy, the determination of the movement intention or the determination of the movement direction can be performed with higher accuracy, and the movement state of the finger can be detected with high accuracy.

F. Modification Examples

The invention is not limited to the foregoing embodiments and modes for carrying out the invention, but can be modified into various forms within the scope of the invention without departing from the gist of the invention and can also be modified as follows, for example.

F1. Modification Example 1

The finger joint driving devices have been exemplified as the driving device according to the invention, but the invention is not limited thereto. Each of the units included in the finger joint driving device can be substituted with a unit having any configuration of the same function. Further, any constituent may also be added. In the foregoing embodiments, any two or more of the configurations (characteristics) may also be combined.

F2. Modification Example 2

In the foregoing embodiments, the actuator 6A can serve to rotate the first link portion 3, but may serve to drive approach and separation of the second base portion 5 to and from the first base portion 2. The actuator 6A having the configuration in which the piezoelectric driving device is used as an actuator has been exemplified, but any other actuator can also be used. For example, a general small motor or an electronic actuator can also be used. For example, an actuator including a wire and a tensioner changing a tensile strength of the wire or an actuator including a hose and a pump changing a hydraulic pressure or a pneumatic pressure inside the hose can also be used.

F3. Modification Example 3

In the foregoing embodiments, the driving device (finger joint driving device) assisting motions of joints of the fingers of people have been exemplified, but the invention is not limited thereto. The embodiment can also be applied to driving devices that assist motions of other biological parts such as toes, elbows, wrists, knees, necks, and waists of people. The embodiments can also be applied to driving devices that assist motions of biological parts of animals and non-biological parts of robots or the like, as well as human beings.

F4. Modification Example 4

In the foregoing third to fifth embodiments, the sum of the outputs of the plurality of force sensors are simply used to determine the movement intention and determine the movement direction. A moment component by bending or spreading of a finger may be obtained based on a distribution of the values of the outputs of the respective sensors, only a vertical direction component to a sensor surface of each sensor may be separated, and the separated vertical direction component may be used.

In the foregoing third to fifth embodiments, the reason why the sum of the outputs of the plurality of sensors is used is that the cases in which the force sensors detecting a force are adopted as the sensors are exemplified. For example, when a pressure sensor detecting a force (pressure) per unit area is used as a sensor, an average value of the plurality of sensors may be obtained and the determination of the motion intention and the determination of the movement direction may be performed based on the acquired pressures. Further, the determination of the motion intention and the determination of the movement direction may be performed based on a force obtained by multiplying the acquired average value by a pressure reception area.

The invention is not limited to the above-described embodiments, the modes, and the modification examples, but can be implemented with various configurations within the scope of the invention without departing from the gist of the invention. For example, the technical characteristics of the embodiments, the modes, and the modification examples corresponding to the technical characteristics of the aspects described in the summary of the invention can be appropriately replaced or combined to resolve some or all of the above-described problems or to attain some or all of the above-describe advantages. When the technical characteristics are not described as requisites in the present specification, the technical characteristics can be appropriately deleted.

The entire disclosure of Japanese Patent Application No. 2014-111177, filed May 29, 2014 and 2014-123919, filed Jun. 17, 2014 are expressly incorporated by reference herein.

What is claimed is:

1. A driving device comprising:

a wearable mechanism that is configured to be worn on a wearing part;

an actuator that drives the wearable mechanism; and first and second force sensors that are provided on the wearable mechanism and detect a force, wherein the first and second force sensors are provided at positions at which a first detected value obtained from the first force sensor and a second detected value obtained from the second force sensor are changed in response to a motion of the wearing part, and wherein when a difference between the first and second detected values is less than a pre-decided first threshold value and the first or second detected value is greater than a pre-decided second threshold value, the actuator drives the wearable mechanism so that the second detected value is constant.

2. The driving device according to claim 1, wherein the actuator drives the wearable mechanism based on the first or second detected value when the difference between the first and second detected values is equal to or greater than the first threshold value.

3. The driving device according to claim 1, wherein the wearing part is a finger, wherein the first force sensor is configured to be disposed on a dorsal side of the finger, and wherein the second force sensor is configured to be disposed on a ventral side of the finger.

4. The driving device according to claim 3, wherein the first and second force sensors are configured to be disposed to face each other in a direction in which the finger is rotated.

5. The driving device according to claim 3, wherein the wearable mechanism includes at least one of assistant units including an assistant portion that is configured to be disposed on the dorsal side of the finger and an interposing portion that is fixed to the assistant portion and is configured to interpose the finger to cover the ventral side of the finger, wherein the first force sensor is disposed on a surface of the assistant portion on the dorsal side of the finger, wherein the second force sensor is disposed on a surface of the interposing portion on the ventral side of the finger, wherein the driving device includes a control unit that controls a movement of the actuator, and wherein a) the control unit determines that a movement state is a free stop state in which a hand including the finger does not grip a gripping target and stops when the difference between the first and second detected values is less than the first threshold value and the first or second detected value is less than the second threshold value, b) the control unit determines that the movement state is a grip force maintenance state in which the hand grips the gripping target with a constant grip force when the difference between the first and second detected values is less than the first threshold value and the first or second detected value is equal to or greater than the second threshold value, c) the control unit determines that the movement state is a free grasp movement state in which the hand grips the gripping target from the state in which the hand does not grip the gripping target when the difference between the first and second detected values is equal to or greater than the first threshold value, the second detected value is greater than the first detected value, and the first detected value is less than the second threshold value, d) the control unit determines that the movement state is a grip progress state in which the hand grips the gripping target from the state in which the hand grips the gripping target when the difference between the first and second detected values is equal to or greater than the first threshold value, the second detected value is greater than the first detected value, and the first detected value is equal to or greater than the second threshold value, e) the control unit determines that the movement state is a grip release movement state in which the hand opens from the state in which the hand grips the gripping target when the difference between the first and second detected values is equal to or greater than the first threshold value, the second detected value is equal to or less than the first detected value, and the second detected value is equal to or greater than the second threshold value, and f) the control unit determines that the movement state is a free release movement state in which the hand opens from the state in which the hand does not grip the gripping target when the difference between the first and second detected values is equal to or greater than the first threshold value, the second detected value is equal to or less than the first detected value, and the second detected value is less than the second threshold value.

6. The driving device according to claim 3, wherein the wearable mechanism includes at least one of assistant units including an assistant portion that is configured to be disposed on the dorsal side of the finger and an interposing portion that is fixed to the assistant portion and is configured to interpose the finger to cover the ventral side of the finger, wherein the first force sensor is disposed on a surface of the assistant portion on the dorsal side of the finger, wherein the second force sensor is disposed on an opposite surface of the interposing portion to the ventral side of the finger, wherein the first detected value is a value obtained by subtracting an offset value according to a wearing pressure occurring when the wearable mechanism is worn on the finger, wherein the driving device includes a control unit that controls a movement of the actuator, and wherein a) the control unit determines that a movement state is a free stop state in which a hand including the finger does not grip a gripping target and stops when the difference between the first and second detected values is less than the first threshold value and the second detected value is equal to or less than the second threshold value, b) the control unit determines that the movement state is a grip force maintenance state in which the hand grips the gripping target with a constant grip force when the difference between the first and second detected values is less than the first threshold value and the second detected value is equal to or greater than the second threshold value, c) the control unit determines that the movement state is a free grasp movement state in which the hand grips the gripping target from the state in which the hand does not grip the gripping target when the difference between the first and second detected values is equal to or greater than the first threshold value, the second detected value is equal to or less than the second threshold value, and the first detected value is less than the second detected value, d) the control unit determines that the movement state is a grip progress state in which the hand grips the gripping target from the state in which the hand grips the gripping target when the difference between the first and second detected values is equal to or greater than the first threshold value, the second detected value is greater than the second threshold value, and the first detected value is less than the second detected value, e) the control unit determines that the movement state is a grip release movement state in which the hand opens from the state in which the hand grips the gripping target when the difference between the first and second detected values is equal to or greater than the first threshold value, the second detected value is greater than the second threshold value, and the first detected value is equal to or greater than the second detected value, and f) the control unit determines that the movement state is a free release movement state in which the hand opens from the state in which the hand does not grip the gripping target when the difference between the first and second detected values is equal to or greater than the first threshold value, the second detected value is equal to or less than the second threshold value, and the first detected value is equal to or greater than the second detected value.

7. The driving device according to claim 5, wherein the control unit switches a driving state of the wearable mechanism by the actuator based on the determined movement state.

8. The driving device according to claim 1, wherein the actuator includes a piezoelectric driving device that generates a driving force driving the wearable mechanism, wherein the piezoelectric driving device includes a vibration plate having first and second surfaces and a vibration structure disposed on at least one of the first and second surfaces of the vibration plate, and wherein the vibration structure includes a piezoelectric substance and first and second electrodes that interpose the piezoelectric substance.

9. A driving device comprising:

a wearable mechanism that is configured to be worn on a wearing part;

an actuator that drives the wearable mechanism; and first and second force sensors that are provided on the wearable mechanism and detect a force, wherein the first and second force sensors are provided at positions at which a first detected value obtained from the first force sensor and a second detected value obtained from the second force sensor are changed in response to a motion of the wearing part, and wherein when a difference between the first and second detected values is less than a pre-decided first threshold value, the first or second detected value is greater than a pre-decided second threshold value, and the wearable part comes into contact with an object provided with a third force sensor detecting a force having a third detected value, the actuator drives the wearable mechanism so that the second and third detected values are constant.

10. A driving method of a driving device, wherein the driving device includes a wearable mechanism that is configured to be worn on a wearing part, an actuator that drives the wearable mechanism, and first and second force sensors that are provided on the wearable mechanism and detect a force, wherein the first and second force sensors are provided at positions at which a first detected value obtained from the first force sensor and a second detected value obtained from the second force sensor are changed in response to a motion of the wearing part, and wherein the driving method comprising:

driving the wearable mechanism so that a second detected value is constant when a difference between the first and second detected values is less than a pre-decided first threshold value and the first or second detected value is greater than the second threshold value.

* * * * *